US009394154B2

(12) United States Patent
Connerat et al.

(10) Patent No.: US 9,394,154 B2
(45) Date of Patent: Jul. 19, 2016

(54) BEVERAGE DISPENSER CONTAINER AND CARTON

(71) Applicant: The Coca-Cola Company, Atlanta, GA (US)

(72) Inventors: Bryan Connerat, Atlanta, GA (US); Mark Friedlein, Peachtree City, GA (US); Carlos J. Ayala-Diaz, Dacula, GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 14/209,684

(22) Filed: Mar. 13, 2014

(65) Prior Publication Data

US 2014/0263454 A1 Sep. 18, 2014

Related U.S. Application Data

(60) Provisional application No. 61/792,959, filed on Mar. 15, 2013.

(51) Int. Cl.

| | |
|---|---|
| ***B67D 3/00*** | (2006.01) |
| ***B67D 1/00*** | (2006.01) |
| ***B67D 7/06*** | (2010.01) |
| ***B67D 7/84*** | (2010.01) |
| ***B65D 5/72*** | (2006.01) |
| ***B65D 77/06*** | (2006.01) |

(52) U.S. Cl.

CPC ..... *B67D 1/0004* (2013.01); *B65D 5/726* (2013.01); *B65D 77/065* (2013.01); *B67D 1/0078* (2013.01); *B67D 3/0029* (2013.01); *B67D 3/0067* (2013.01); *B67D 7/06* (2013.01); *B67D 7/84* (2013.01); *Y10T 29/49826* (2015.01)

(58) Field of Classification Search

USPC ..... 222/105, 129.1, 129.4, 465.1, 325, 222/181.1, 183, 131, 207; 206/459.5; 220/669; 99/323.2

See application file for complete search history.

(56) References Cited

U.S. PATENT DOCUMENTS

| | | | | |
|---|---|---|---|---|
| 3,233,817 | A | 2/1966 | Casady | |
| 3,908,864 | A | 9/1975 | Capper | |
| 6,412,663 | B1 * | 7/2002 | Adamson, II | A47G 23/0258 220/737 |
| 6,871,679 | B2 | 3/2005 | Last | |

(Continued)

FOREIGN PATENT DOCUMENTS

DE 297 02 300 U1 11/1997

OTHER PUBLICATIONS

International Search Report and Written Opinion for PCT/US2014/029390 mailed Aug. 4, 2014.

*Primary Examiner* — Donnell Long

(57) ABSTRACT

An example system for installing a beverage ingredient into a beverage dispenser includes: a container for insertion of a carton containing a beverage ingredient into a beverage dispenser, the container including a base surface, and a front surface, a back surface, and two side surfaces extending from the base surface and defining a cavity sized to receive the carton; wherein the two side surfaces extend from the front surface at an angle and form a horizontal landing portion that extends to the back surface; and a carton positioned within the container and containing the beverage ingredient, the carton comprising a fitment extending from a carton surface, the fitment sized to allow fluid communication between the carton and the beverage dispenser, and the carton defining a tear away portion defining an angled surface extending from a front surface of the carton to a side surface of the carton.

25 Claims, 31 Drawing Sheets

(56) References Cited

U.S. PATENT DOCUMENTS

| | | | | |
|---|---|---|---|---|
| 8,201,712 | B2 | 6/2012 | Freeman et al. | |
| 2003/0116584 | A1 | 6/2003 | Gutierrez et al. | |
| 2003/0141317 | A1 | 7/2003 | Vance | |
| 2006/0071021 | A1 | 4/2006 | Steeves et al. | |
| 2006/0138168 | A1* | 6/2006 | Last | B65D 35/28 222/105 |
| 2008/0041882 | A1 | 2/2008 | Lips | |
| 2008/0121766 | A1* | 5/2008 | Jorgensen | B67D 3/0083 248/150 |
| 2008/0277417 | A1* | 11/2008 | Groesbeck | B65D 5/4204 222/105 |
| 2008/0283550 | A1 | 11/2008 | Nighy et al. | |
| 2009/0283541 | A1* | 11/2009 | Compton | B65D 77/068 222/105 |
| 2010/0147884 | A1 | 6/2010 | Compton et al. | |
| 2014/0263442 | A1 | 9/2014 | Connerat et al. | |

* cited by examiner

BEVERAGE DISPENSER CONTAINER AND CARTON

RELATED APPLICATION(S)

This application claims the benefit of U.S. Patent Application Ser. No. 61/792,959 filed on Mar. 15, 2013, the entirety of which is hereby incorporated by reference.

BACKGROUND

Beverage dispensers require ingredients to be added in order to form the beverage. Ingredients such as still water can be delivered directly from a plumbing system. Ingredients that give a beverage its taste, color, etc., may be installed using cartridges that contain the ingredients. These cartridges are expensive to manufacture and have to be discarded or recycled after they are depleted.

BRIEF DESCRIPTION OF THE DRAWINGS

The accompanying drawings, which are incorporated in and constitute a part of this disclosure, illustrate various embodiments. In the drawings.

SUMMARY

Figure 1:
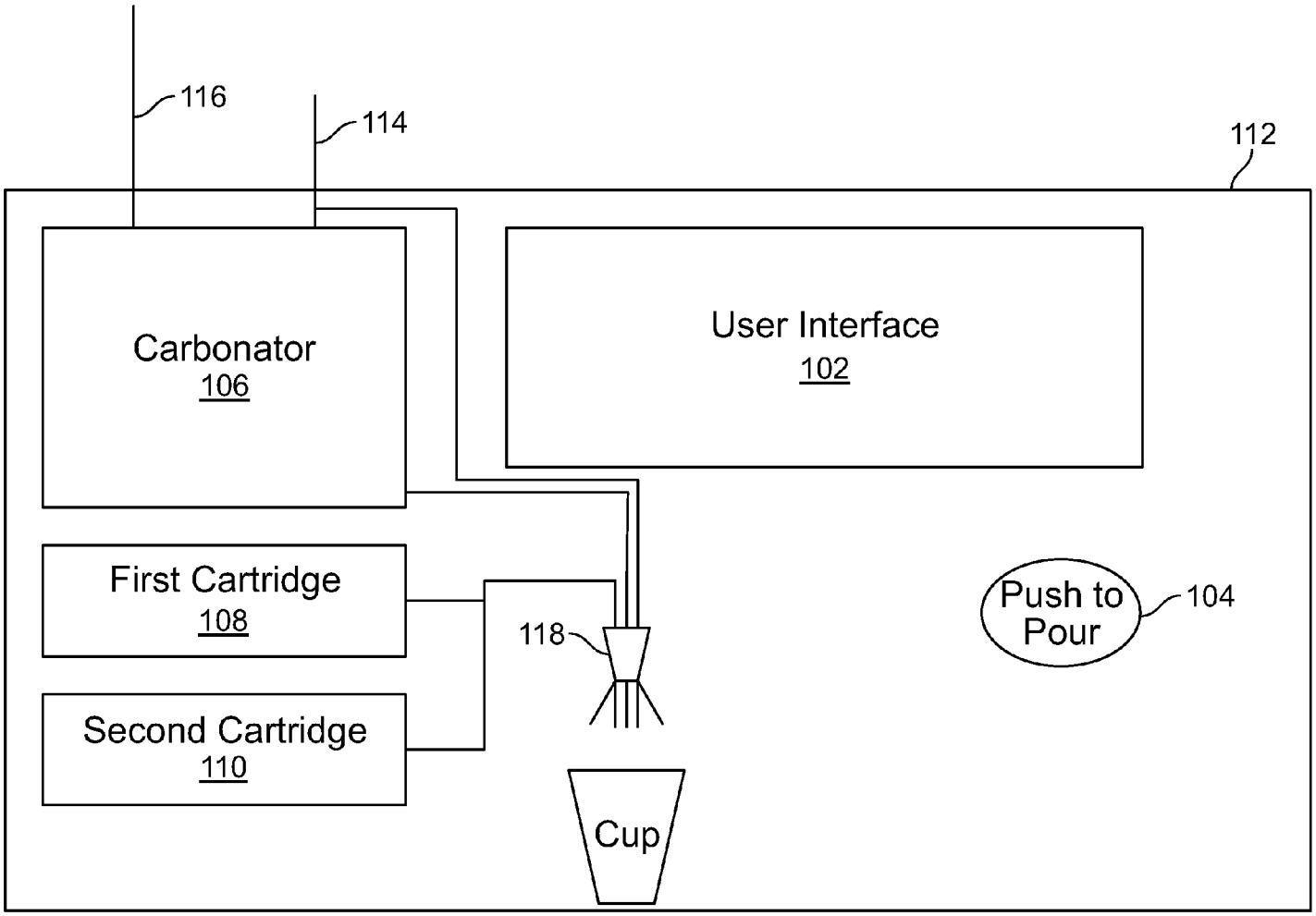
FIG. 1 shows a schematic of a beverage dispenser.
Figure 2A:
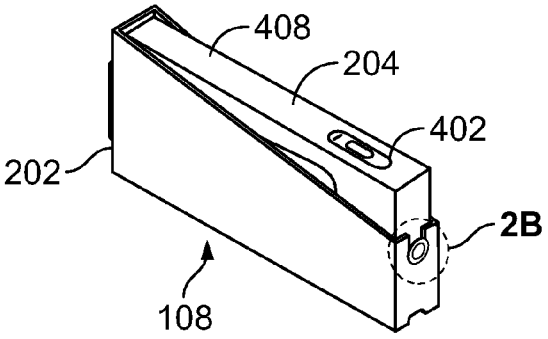
FIG. 2*a* shows a front perspective view of a cartridge in accordance with the principles of the present disclosure.
Figure 2B:
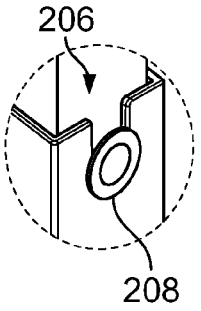
FIG. 2*b* shows an enlarged view of a portion of FIG. 2*a*.
Figure 2C:
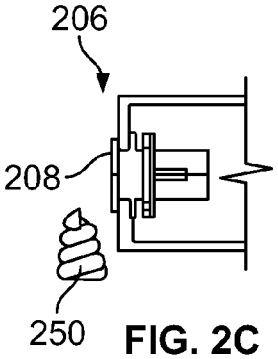
FIG. 2*c* shows a cross-sectional view of a portion of FIG. 2*a*.
Figure 2D:
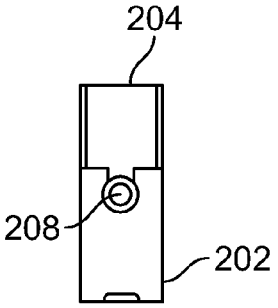
FIG. 2*d* shows a front view of FIG. 2*a*.
Figure 2E:
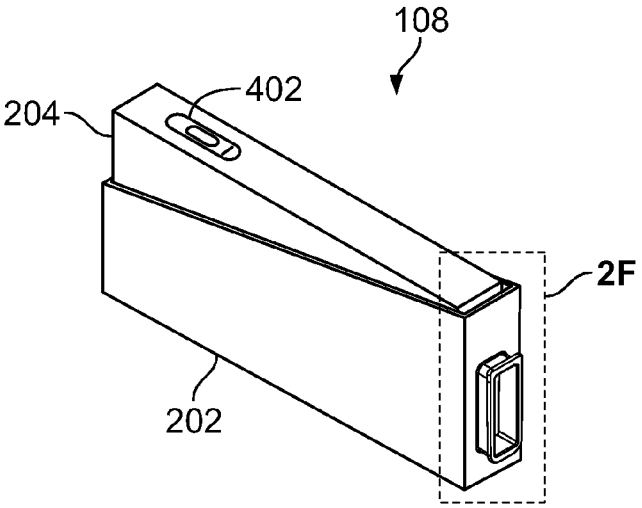
FIG. 2*e* shows a rear isometric view of FIG. 2*a*.
Figure 2F:
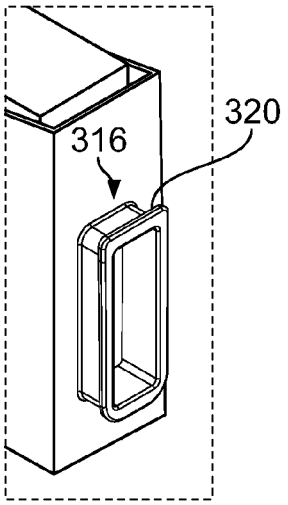
FIG. 2*f* shows an enlarged view of a portion of FIG. 2*e*.
Figure 2G:
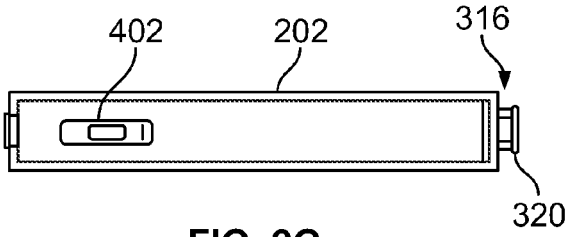
FIG. 2*g* shows a top view of FIG. 2*a*.
Figure 2H:
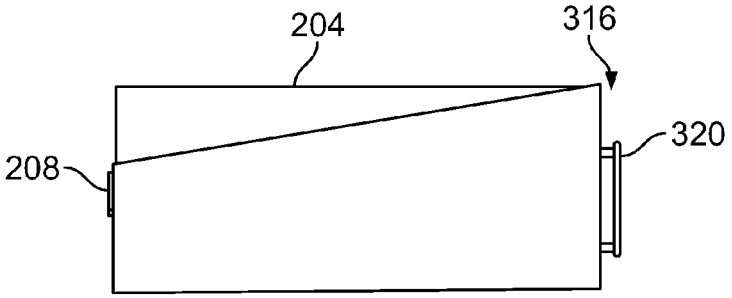
FIG. 2*h* shows a side view of FIG. 2*a*.
Figure 2I:
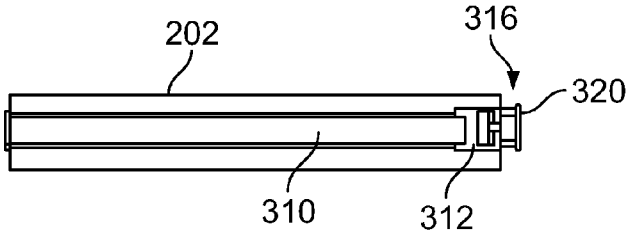
FIG. 2*i* shows a bottom view of FIG. 2*a*.
Figure 2J:
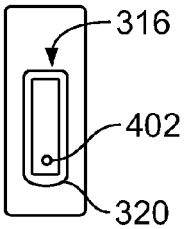
FIG. 2*j* shows a rear view of FIG. 2*a*.
Figure 3A:
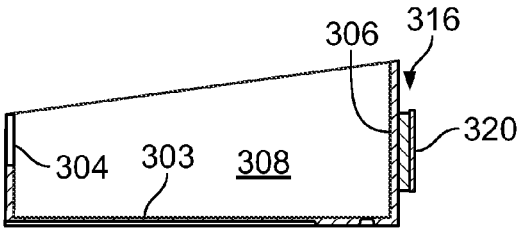
FIG. 3*a* shows a cross-sectional side view of a container in accordance with the principles of the present disclosure.
Figure 3B:
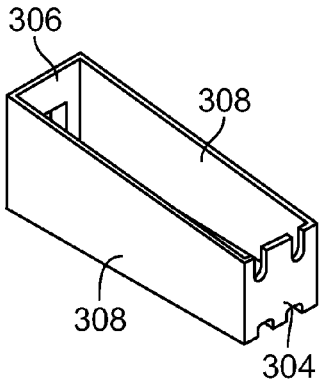
FIG. 3*b* shows a perspective view of the container of FIG. 3*a*.
Figure 3C:
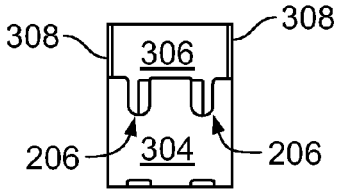
FIG. 3*c* shows a front view of the container of FIG. 3*a*.
Figure 3D:
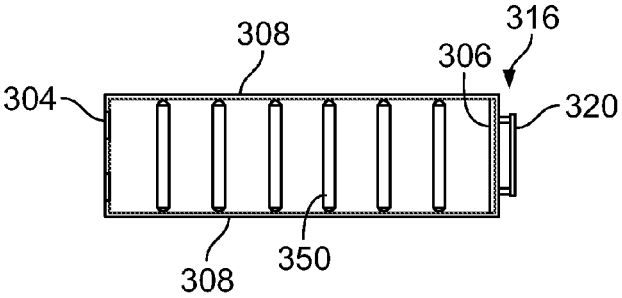
FIG. 3*d* shows a top view of the container of FIG. 3*a*.
Figure 3E:
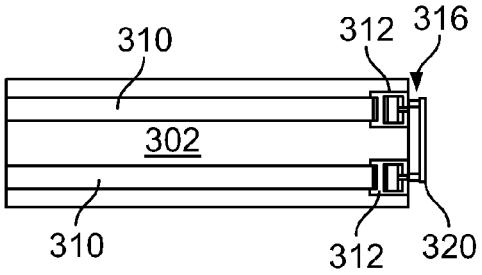
FIG. 3*e* shows a bottom view of the container of FIG. 3*a*.
Figure 3F:
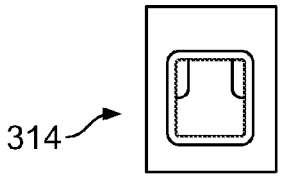
FIG. 3*f* shows a rear view of the container of FIG. 3*a*.
Figure 3G:
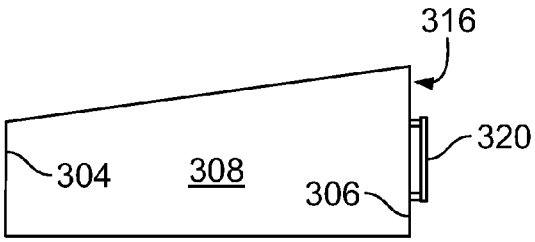
FIG. 3*g* shows a side view of the container of FIG. 3*a*.
Figure 3H:
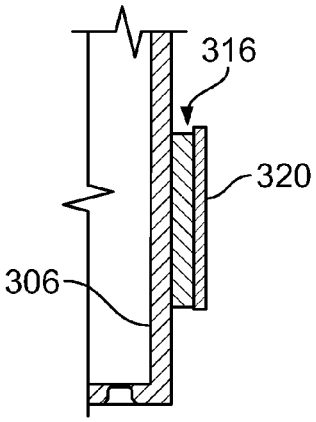
FIG. 3*h* shows an enlarged view of a portion of FIG. 3*a*.
Figure 4A:
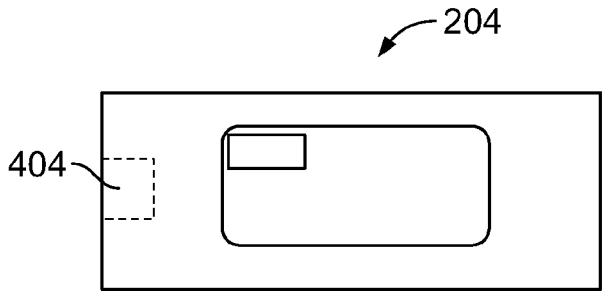
FIG. 4*a* shows a left side view of a carton in accordance with the principles of the present disclosure.
Figure 4B:
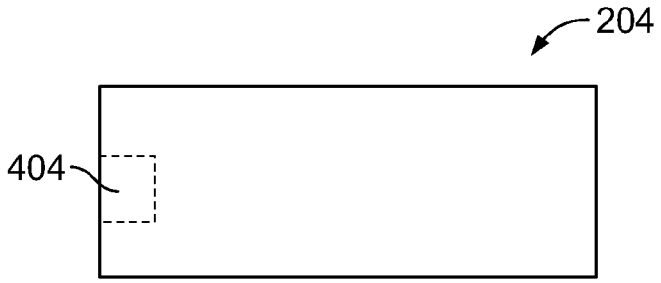
FIG. 4*b* shows a right side view of the carton of FIG. 4*a*.
Figure 4C:
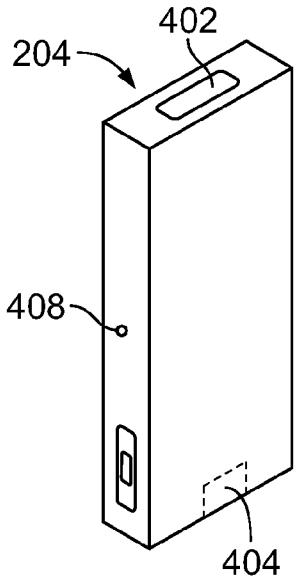
FIG. 4*c* shows a right perspective view of the carton of FIG. 4*a*.
Figure 4D:
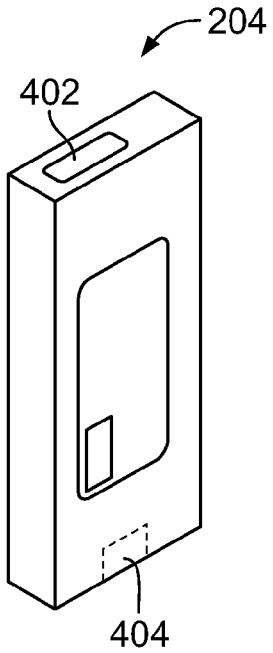
FIG. 4*d* shows a left perspective view of the carton of FIG. 4*a*.
Figure 4E:
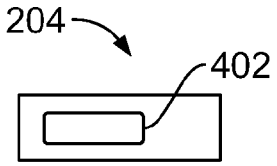
FIG. 4*e* shows a rear view of the carton of FIG. 4*a*.
Figure 4F:
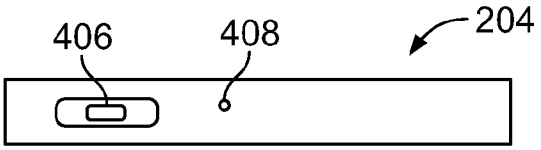
FIG. 4*f* shows a top view of the carton of FIG. 4*a*.

In one aspect, an example system for installing a beverage ingredient into a beverage dispenser includes: a container for insertion of a carton containing a beverage ingredient into a beverage dispenser, the container including a base surface, and a front surface, a back surface, and two side surfaces extending from the base surface and defining a cavity sized to receive the carton; wherein the two side surfaces extend from the front surface at an angle and form a horizontal landing portion that extends to the back surface; and a carton positioned within the container and containing the beverage ingredient, the carton comprising a fitment extending from a carton surface, the fitment sized to allow fluid communication between the carton and the beverage dispenser, and the carton defining a tear away portion defining an angled surface extending from a front surface of the carton to a side surface of the carton.

DESCRIPTION

The following detailed description refers to the accompanying drawings. Wherever possible, the same reference numbers are used in the drawings and the following description to refer to the same or similar elements. While embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure.

Embodiments include a container for insertion of a carton containing a beverage ingredient into a beverage dispenser. The container includes a base surface and a front surface, a back surface, and two side surfaces that extend from the base surface. The surfaces define a cavity sized to receive the carton.

Embodiments include a system for installing a beverage ingredient into a beverage dispenser. A carton contains the beverage ingredient. The carton includes a pouch with a fitment adapted to extend from a carton surface. The fitment is sized to allow fluid communication between the pouch and the beverage dispenser. A container includes a front surface, a back surface, and two side surfaces extending from a base surface. The front surface, the back surface, and the two side surfaces define a cavity sized to receive the carton. The front surface defines a landing sized to securely receive the fitment.

Embodiments include a method for inserting the carton containing the beverage ingredient into the beverage dispenser. The method includes inserting the carton into the container, partially inserting the container into the beverage dispenser, and causing a fitment to engage the beverage dispenser. The fitment protruding from the carton.

Embodiments include a method for manufacturing a carton and container for housing a beverage ingredient. The method includes injection molding the container to define a cavity for receiving the carton, and fabricating the carton such that the fitment protrudes from a carton surface when installed in the container. The fitment is for establishing fluid communication with a beverage dispenser.

Now turning to the figures, FIG. 1 shows a simplified schematic of a beverage dispenser 100. The beverage dispenser 100 includes a user interface 102, a pour input 104, a carbonator 106, and a plurality of ingredient cartridges (e.g., a first cartridge 108 a second cartridge 110) all enclosed in a housing 112. It should be understood that the user interface 102 may comprise any number of interfaces including, but not limited, a touchscreen, product selection buttons, one or more pour buttons and/or other user input devices. The buttons may include mechanical components or linkages, or may be electronic buttons such as a capacitive touch button. Furthermore, one or more of the buttons may be substituted by a lever or other mechanical or electronic actuation device. It should be further noted, that in accordance with alternative embodiments, some or all of the aforementioned ingredient cartridges may be installed remotely from the housing 112 and pumped or otherwise supplied to the beverage dispenser 100. In accordance with various embodiments, the pour input 104 may comprise a button or other inputs on the user interface 102 or alternatively, an input distinct from the user interface 102 such as a mechanical button or lever, an electrical touch sensitive surface such as a capacitive touch button or other distinct user input device for initiating the pouring of a beverage. It should be understood that the first and second cartridges 108 and 110 may include any number of ingredients including, but not limited to, sweetened beverage bases or beverage syrups, sweetened flavors or flavor syrups, unsweetened beverage bases, unsweetened beverage base components (such as the acid, acid-degradable, and non-acid portions of a beverage base), unsweetened flavors, natural and artificial flavors, flavor additives, natural and artificial colors, nutritive or non-nutritive natural or artificial sweeteners, additives for controlling tartness (e.g., citric acid, potassium citrate, etc.), functional additives such as vitamins, minerals, or herbal extracts, nutraceuticals, medicaments, or alternative diluents such as juice, milk, or yoghurt. The ingredients may be concentrated with traditional beverage ingredients having reconstitution ratios of about 3:1 to about 6:1 or higher. The beverage micro-ingredients may have reconstitution ratios from about 10:1, 20:1, 30:1, or higher with many having reconstitution ratios of 50:1 to 300:1. The viscosities of the ingredients may range from about 1 to about 100 centipoise. While FIG. 1 shows the beverage dispenser 100 having two cartridges, the beverage dispenser 100 include any number of cartridges. The beverage dispenser 100 includes a still water input 114 and a $CO_2$ input 116. The still water input 114 and the $CO_2$ input 116 supply still water and $CO_2$ to the carbonator 106. The still water input 114 may also be supplied to a nozzle 118 for use in pouring still beverage from the beverage dispenser 100. One of ordinary skill in the art will recognize that the beverage dispenser may include one or more pumps, valves, flow control devices, or other devices (not shown) to control the flow of fluids through the beverage dispenser.

During operation, the beverage dispenser 100 receives a user selection of a beverage from the user interface 102. After the beverage is selected, the beverage dispenser 100 dispenses the beverage in response to the user pressing the pour input 104. During dispensing, carbonated water from the carbonator 106, still water from the still water input 114, or other diluents flow to the nozzle 118. At the same time, one or more beverage ingredients for the beverage flow from one or more of the plurality of cartridges to the nozzle 118. The nozzle 118 facilitates the dispensing and mixing of the various ingredients and diluents for producing a finished beverage. For example, the carbonated water may flow from the carbonator 106, a beverage base may flow from the first cartridge 108, and sweetener may flow from the second cartridge 110. The various ingredients may flow to the nozzle 118 where they are combined to from a "post-mix" finished beverage. In some embodiments, one or more of the ingredients remain separate until the exit the nozzle 118 and air mix within the fluid stream flowing out of the nozzle 118.

FIGS. 2*a-j* show a multi-view of one of the plurality of cartridges (e.g., a first cartridge 108). First cartridge 108 may include a container 202 (described in greater detail below with references to FIGS. 3*a-h*) and a carton 204 (described in greater detail below with references to FIGS. 4*a-f* and FIG. 5). The carton 204 contains a bag, pouch, bladder, or other flexible, semi-flexible or non-flexible ingredient container (not shown) which stores beverage ingredients. In some embodiments, the ingredient container may be a rigid or semi-rigid container. In some embodiments, the ingredient container may be prone to breakage or otherwise difficult or expensive to handle or ship outside of the structure and protection provided by the carton 204. The ingredient container includes a fitment 208 for providing access to the beverage ingredients stored therein. In some embodiments, the carton may be a laminated container for directly storing the beverage ingredients without the use of an additional ingredient container. For example, the carton may be a carton described in U.S. Pat. No. 8,201,712 to Freeman et. al., incorporated herein by reference in its entirety for all purposes.

Figure 8A:
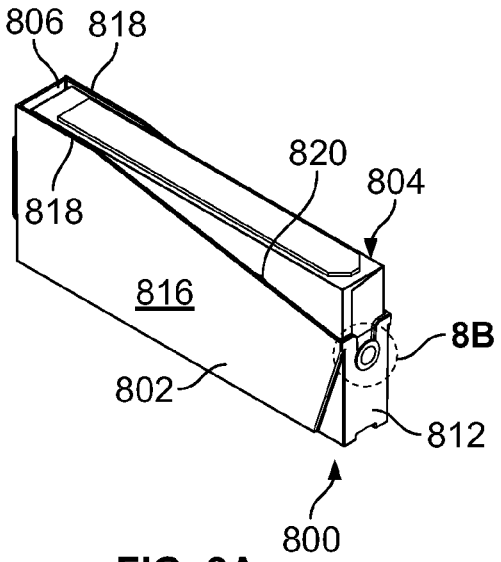
FIG. 8*a* shows a front perspective view of another cartridge in accordance with the principles of the present disclosure.
Figure 8B:
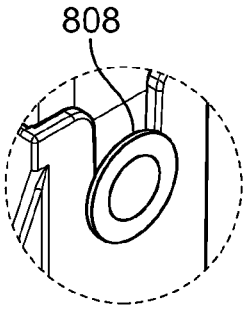
FIG. 8*b* shows an enlarged portion of the cartridge of FIG. 8*a*.
Figure 8C:
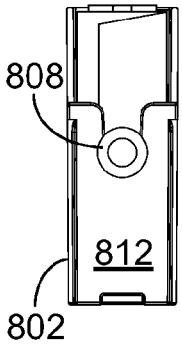
FIG. 8*c* shows a front view of the cartridge of FIG. 8*a*.
Figure 8D:
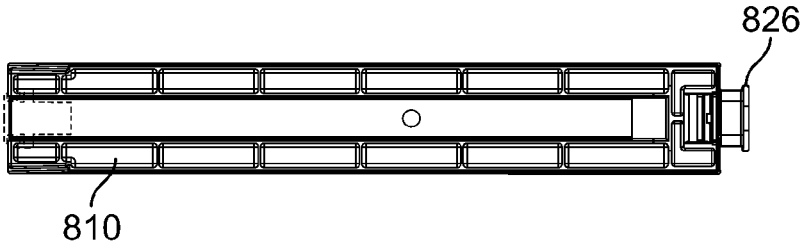
FIG. 8*d* shows a bottom view of the cartridge of FIG. 8*a*.
Figure 8E:
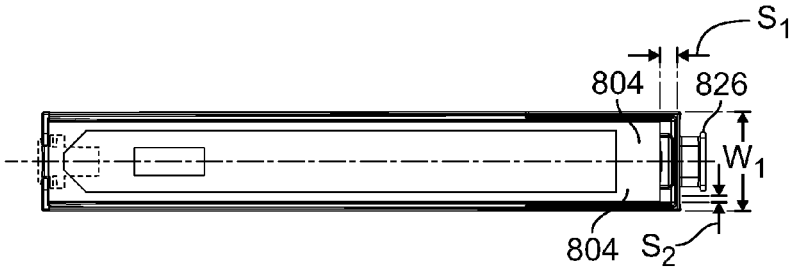
FIG. 8*e* shows a top view of the cartridge of FIG. 8*a*.
Figure 8F:
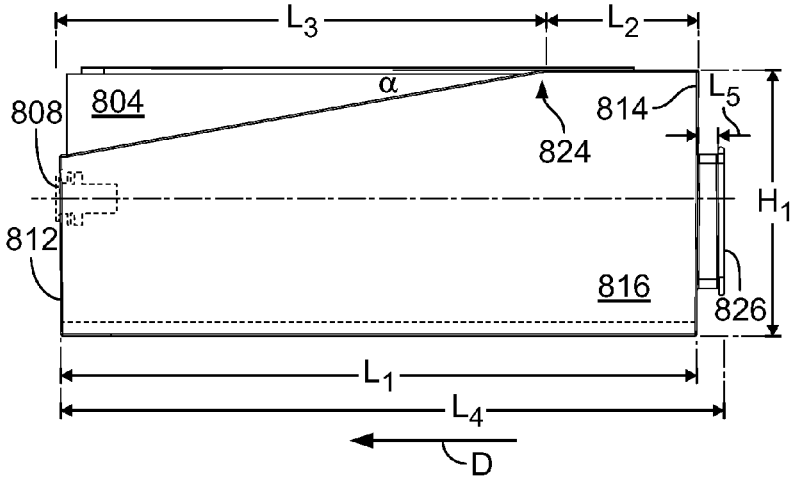
FIG. 8*f* shows a side view of the cartridge of FIG. 8*a*.
Figure 8G:
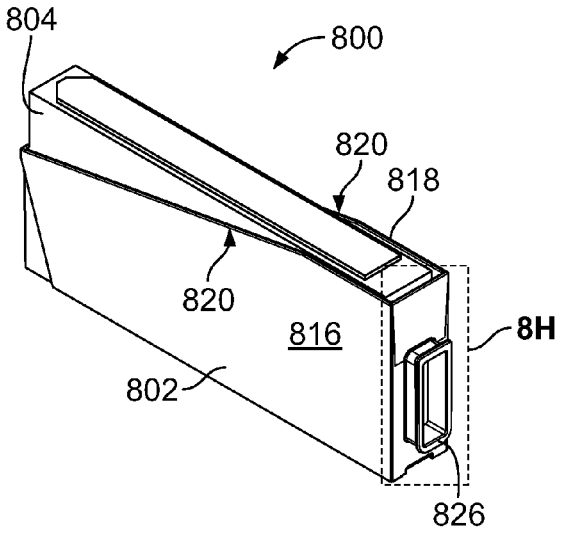
FIG. 8*g* shows a rear perspective view of the cartridge of FIG. 8*a*.
Figure 8H:
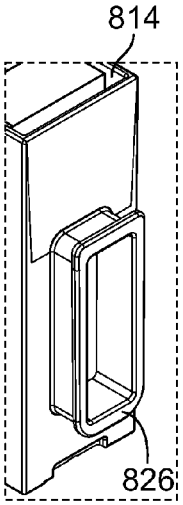
FIG. 8*h* shows an enlarged portion of the cartridge of FIG. 8*g*.
Figure 8J:
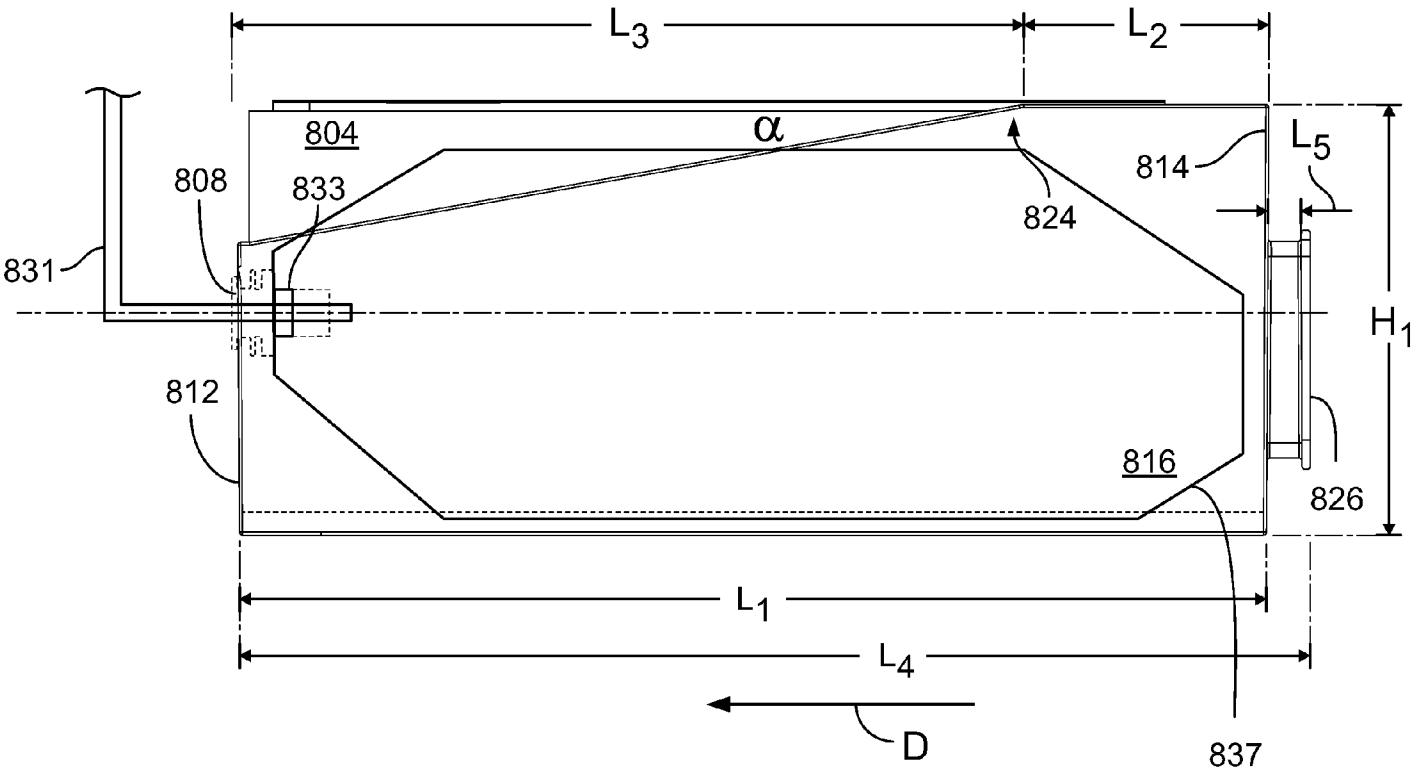
FIG. 8*j* shows a side view of the cartridge of FIG. 8*a* with a probe inserted.
Figure 8I:
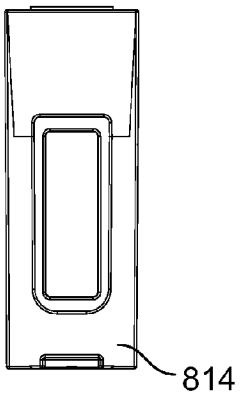
FIG. 8*i* shows a rear view of the cartridge of FIG. 8*a*.

In some embodiments, the carton 204 may be made, at least in part, of paperboard, cardboard, honeycomb board, or other inexpensive and relatively available materials. Other materials or laminates may be used to construct the carton 204. As shown in FIGS. 2*a-i* the carton 204 fits within the container 202. When the carton 204 is inserted within the container 202, a landing 206 receives the fitment 208. In some embodiments, the landing 206 may include a spring element or tab on either side of the landing 206 for securely holding the fitment 208 in the landing 206. In some embodiments, the spring element may apply a positive downward force on the fitment 208 or otherwise lock the fitment 208 in place so as to ensure proper seating and alignment of the fitment within the container 202. Moreover, the fitment 208 may include a lip or flange that engages with a front surface of the container 202 about the landing 206 so as to prevent the fitment 208 from passing through the landing 206. The fitment 208 connects with plumbing inside the beverage dispenser 100 via a probe (see FIG. 8J) to establish fluid communication between the beverage ingredients stored in the carton 204 and the nozzle 118. Generally, the probe may be inserted into the fitment 208 and engage with and open a plug (see FIG. 8J) of the fitment 208, thereby establishing a fluid pathway for the beverage ingredients through the probe and on to the nozzle 118. Upon retracting the probe from the fitment 208, the plug of the fitment 208 may be closed to prevent spilling of the beverage ingredients through the fitment 208. In some embodiments, the probe and the fitment 208 may take the form of those described in U.S. Pat. No. 6,871,679 to Last, incorporated herein by reference in its entirety for all purposes. In some embodiments, fluid may be supplied in a probe and fitment arrangement provided by, for example, the model IPN FC78 fitment from Innovative Packaging Network (IPN) Group of Peachtree City, Ga. As shown in FIGS. 2*a-j*, the container 202 includes a base surface, a front surface, a back surface and two side surfaces. As described in more detail below with reference to FIG. 5, the container 202 may be a single piece of injection molded plastic. In some embodiments, the container 202 may be made of other materials, such as metals, ceramics, wood, or any other materials or combinations thereof. Moreover, the container 202 may be constructed using any manufacturing process.

The container 202 may be used to insert the carton 204 into the beverage dispenser 100. A certain amount of force, $F_f$, may be applied to the fitment upon insertion of the probe to properly install the probe and open the plug so as to facilitate fluid communication of the beverage ingredients to the nozzle 118. However, in some embodiments, the carton 204 or ingredient container contained alone, or in combination, may not be sufficiently rigid or otherwise structurally strong enough so as to support the fitment 208 upon the application of force $F_f$ upon insertion of the probe. In other words, the carton 204 and/or ingredient container may bend, flex, or otherwise give way upon the application of for $F_f$, thereby preventing proper installation of the probe into the fitment 208. However, upon installing the carton 204 into the container 202 and seating the fitment 208 in the landing 206, the container 202 provides sufficient structural support to the fitment to enable proper installation of the probe in the fitment 208. In other words, the container 202 supports the fitment 208 in the landing 206 even upon application of the force $F_f$ to the fitment 208, thereby enabling proper installation of the probe in the fitment 208. Therefore, inexpensive materials may be used to store beverage ingredients in the carton 204 during delivering and handling of the beverage ingredients, while more expensive materials may be used to construct the reusable container 202 so as to provide sufficient structural support to the carton 204 to enable installation in the beverage dispenser 100.

FIGS. 3*a-h* show the container 302. The container 302 shown in FIGS. 3*a-h* may accept two of the cartons 204. Thus, each of the cartons 204 in the container 302 may have two pouches. Alternatively, instead of two of the cartons 204, the container 302 may accept a single carton that has the capacity double that of the carton 204 (and thus may also store two pouches). The container 302 includes a base surface 303, a front surface 304, a back surface 306, and two side surfaces 308. The front surface 304, back surface 306, and two side surfaces 308 extend from the base surface 303 and may define a cavity sized to receive two of the carton 204. It should be appreciated that the base surface 303 may further include one or more "speed bumps" 350. In accordance with an embodiment, the speed bumps 350 may help provide a vacuum break and keep the carton 204 from setting in liquid if there are a few drips.

The base surface 303 may define an alignment groove 310. The alignment groove 310 extends from the front surface 304 to the back surface 306. While FIGS. 3*a-h* show the alignment groove 310 extending almost completely from the front surface 304 to the back surface 306, the alignment groove 310 may extend any length of the base surface 303. In addition, the alignment groove 310 may begin at any location along the base surface 303 and extend for any length of the base surface 303. For example, the alignment groove 310 may begin at a midpoint location long the base surface 303 and extend a quarter length of the base surface 303. In addition, multiple alignment grooves may be defined by the base surface 303.

The base surface 303 may also define a recess 312. The recess 312 may be sized to receive an insertion peg (not shown) connected to the beverage dispenser 100. For example, during installation, the insertion peg is connected to a lever connected to the beverage dispenser 100. A user may use the lever to apply an insertion force that is transferred to the insertion peg. The transferred force assists in seating the fitment 208 to the plumbing connecting it to the nozzle 118.

The container 302 includes the landing 206. The landing 206 is defined by the front surface 304. The landing 206 is sized to receive the fitment 208. The landing 206 includes a flexible tab that acts to securely attach the carton 204 to the container 302. The container 302 may include multiple landings 206, one for each pouch fitment to be installed in a landing. In the depicted example, two landings 206 are shown.

The back surface 306 defines an opening 314. The opening 314 is sized to allow a product label 402 located on the carton 204 to be visible when the carton 204 is located within the container 202. The back surface 306 includes a protrusion 316. The protrusion 316 extends from the back surface 306. In addition, the protrusion 316 surrounds the opening 314 without substantially obscuring visibility of the product label 402.

The protrusion 316 is sized to allow the user to grip the protrusion 316. By allowing the user to grip the protrusion 316, the user is able to get a better grip on the container 202. For example, if multiple containers are installed side by side, it may be difficult to grip the two side surfaces 308. By gripping the protrusion 316, the user is able to exert a force great enough on the container 202 to facilitate extracting the container 202 from the beverage dispenser 100. The protrusion 316 may include a flared surface 320. The flared surface 320 facilitates the user to gripping the protrusion 316.

The carton 204 contains the beverage ingredient. The fitment 208 extends from a carton surface (e.g., any exterior surface of the carton 204). The fitment 208 is sized to allow fluid communication between the carton 204 and the beverage dispenser 100.

The carton 204 includes a tear away section 404. The tear away section 404 covers and protects the fitment 208 during delivery and handling of the beverage ingredients. When the tear away section 404 is torn away from the carton 204, the fitment 208 is exposed. The tear away section 404 may be a portion of the carton 204 that is perforated. The perforation allows the tear away section 404 to be torn from the carton 204. Alternatively, the tear away section 404 may be attached to the carton 204 with an adhesive. It should be understood that while the carton and containers (discussed above) are generally shown with a vertical orientation, they may also be modified to have a horizontal orientation without departing from the spirit or scope of the various embodiments described herein.

The carton 204 may include a radio frequency identification (RFID) chip 406. The RFID chip 406 may be attached to an interior or exterior surface of the carton 204. For example, as shown in FIGS. 4*a-f*, the RFID chip 406 may be attached to an exterior surface 408. In addition, the RFID chip 406 may be attached to an interior surface 602 (see FIG. 6). Furthermore, the RFID chip 406 may be embedded within a surface of the carton 204. For example, the exterior surface 408 may include a recess that may allow the RFID chip 406 to be flush with the exterior surface 408. Moreover, the RFID chip 406 may be embedded within the exterior surface 408 and covered. The covering may be made of the same material the carton 204 or made of a different material. The covering protects the RFID chip 406.

The RFID chip 406 may be used to identify the beverage ingredient to the beverage dispenser 100. For example, the RFID chip 406 may be encoded to communicate that the carton 204 is a starter pack. A starter pack may be a carton that is smaller than a standard beverage ingredient pack. For example, the starter pack may contain a small sample of the beverage ingredient for a user to get started using the machine. In addition, the RFID chip 406 may communicate that the carton 204 is a sample pack. Sample packs may be offered to consumers at a lower cost and provide a small sample of the beverage ingredient. Manufacturers may offer sample packs so users can test new flavors and beverages. The sample packs and starter packs may have a carton that is a full size, but may have a bladder or other ingredient container located within the carton 204 that is smaller than the ingredient container that may be located in a standard container. In addition, the carton 204 may contain multiple ingredient containers. For example, the carton 204 may contain two ingredient containers, each with the same or differing ingredients. Each ingredient container has a fitment 208 that engages the landing 206 shown in FIGS. 3*a-h*.

Figure 5:
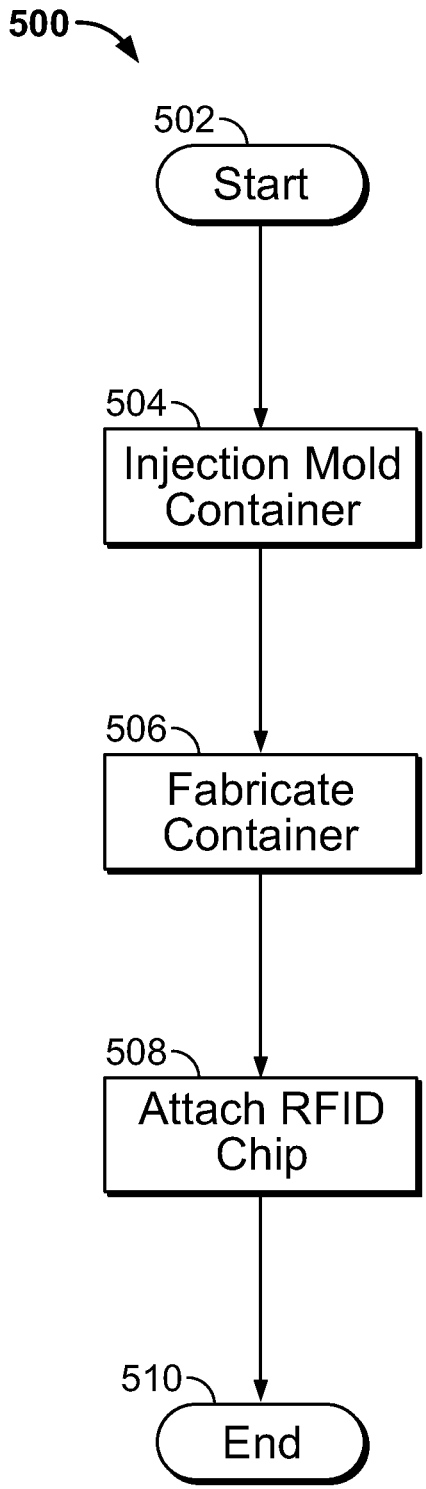
FIG. 5 shows a flow chart for a method for manufacturing a carton and a container for housing a beverage ingredient.

FIG. 5 shows a flow chart for a method 500 for manufacturing the carton 204 and the container 202. The method 500 begins at starting block 502 and progress to stage 504 where the container 202 is injection molded. For example, during stage 504 the container 202 is injection molded to define a cavity for receiving the carton 204. Furthermore, during the injection molding process or in a separate injection molding process, the fitment 208 may be formed. In addition, the landing 206 may be formed during the injection molding process or cut into the container 202 after the injection molding process. The opening 314 may be formed during the injection molding process or cut into the container 202 afterwards.

Other features of the container 202 may be formed during the injection molding process. For example, during the injection molding process the protrusion 316 that extends the back surface 306 may be formed. The protrusion 316 may also be attached to the back surface 306 after the back surface 306 is formed. For instance, the protrusion 316 may be attached to the back surface 306 with an adhesive or ultrasonic welding. The alignment groove 310 may be formed during the injection molding process or cut into the base surface 303. For example, a router may be used to cut the alignment groove 310 into the base surface 303.

From stage 504 where the container 202 is injection molded, the method 500 proceeds to stage 506 where the carton 204 is fabricated. Fabricating the carton 204 include fabricating the carton 204 to include the fitment 208 protruding from surface of the carton 204.

Figure 6:
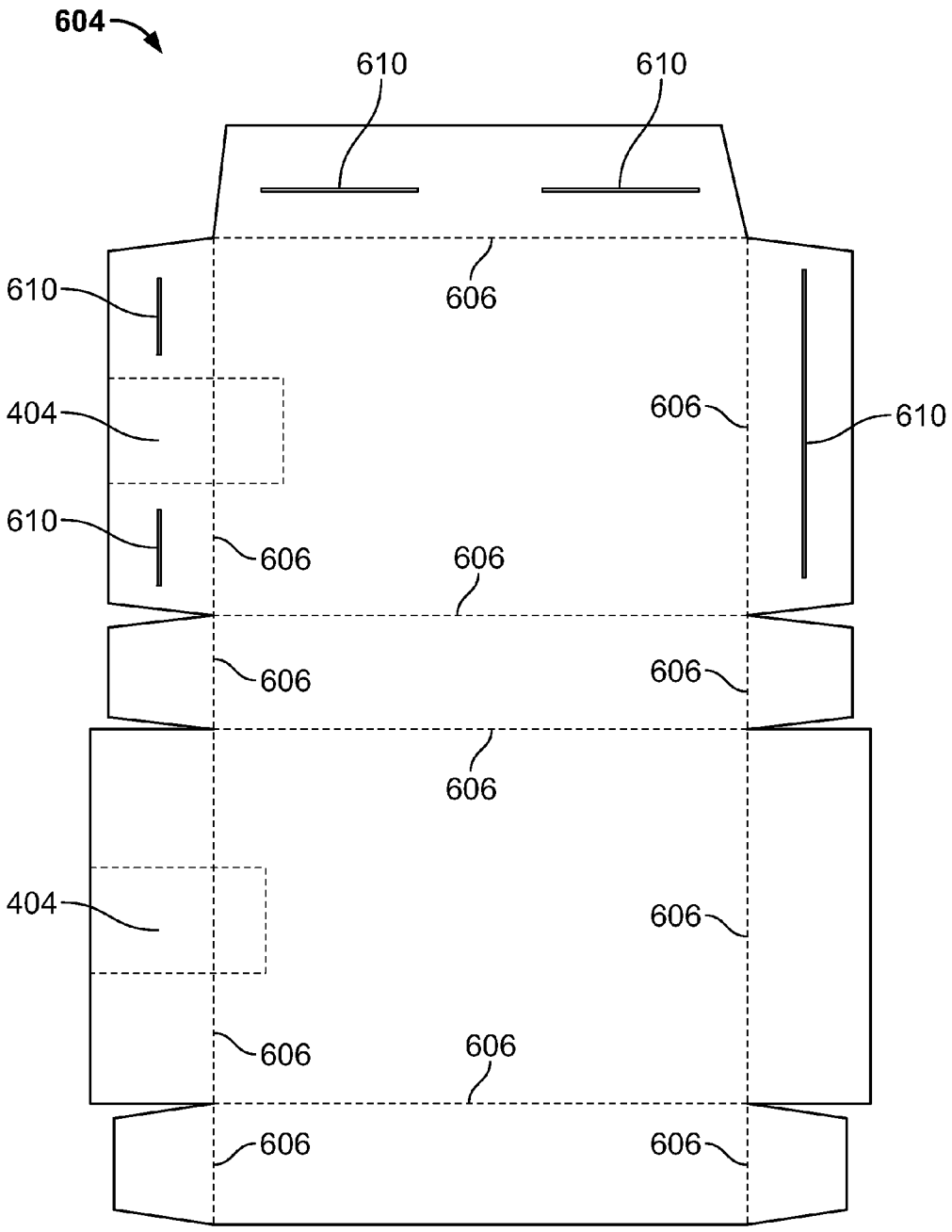
FIG. 6 shows an outline of a carton cut from a flat stock.

During stage 506 an outline 604 of the carton 204 is stamped from a flat stock. For example, FIG. 6 shows the outline 604 of carton 204 cut from a flat stock. Once the outline 604 has been cut, fold lines 606 are scored on a surface 608 of the flat stock. In addition, adhesive striping 610 is applied. The adhesive striping 610 is used to after folding the flat stock along the fold lines 606 to form an enclosure. The bladder is installed before the adhesive striping 610 is used to form the enclosure.

In addition, during stage 506, the tear away section 404 may be formed. For example, perforations may be cut into the flat stock during the stamping process. In addition, the tear away section 404 may be attached to the carton 204 during stage 506.

From stage 506 where the carton is formed, the method 500 may proceed to stage 508 where the RFID chip 406 is applied to the carton 204. For example, during stage 508, the RFID chip 406 may be applied to the interior surface 602 of the carton 204 as shown in FIG. 6. Furthermore, the RFID chip 406 may be embedded within a surface of the carton 204 as shown in FIGS. 4*a-f*. In some embodiments, the RFID chip 406 may be installed on an exterior surface of the carton 204, for example by application of a sticker or other such substrate containing the RFID chip 406. From stage 508 where the RFID chip 406 is installed, the method 500 terminates at termination block 510.

Figure 7:
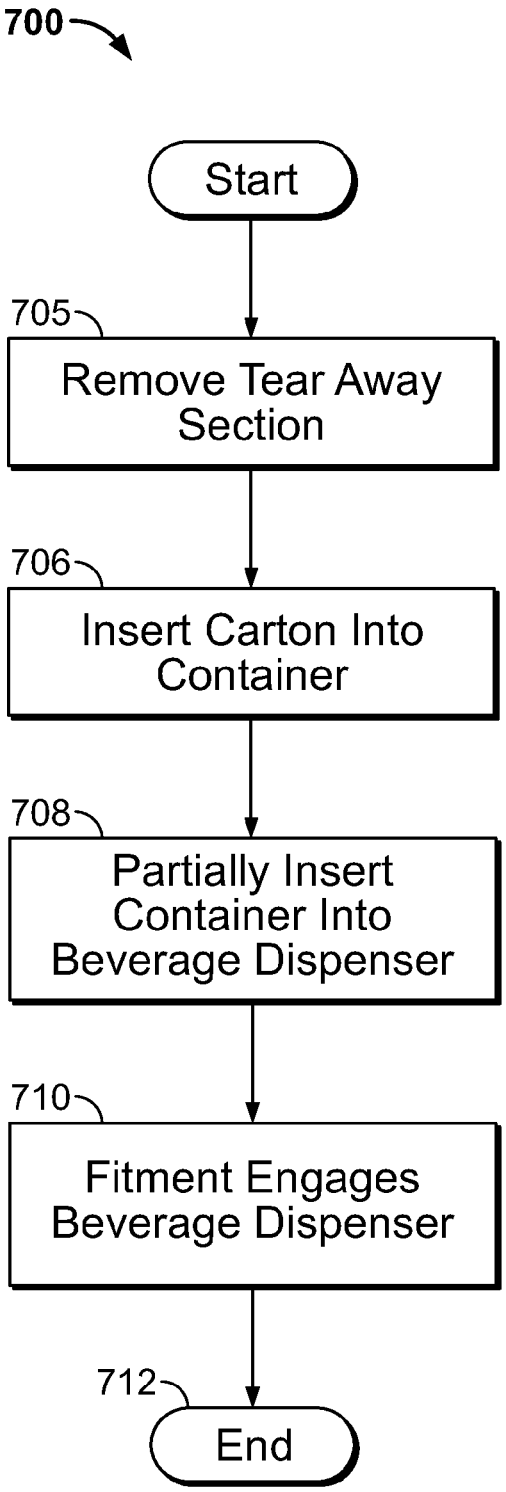
FIG. 7 shows a flow chart for a method for inserting a carton containing a beverage ingredient into a beverage dispenser.

FIG. 7 shows a flow chart for a method 700 for inserting the carton 204 containing a beverage ingredient into the beverage dispenser 100. The method 700 begins at starting block 702 and proceeds to stage 705 where the tear away section 404 is removed from the carton 204. From stage 705 where the tear away section 404 is removed, the method 700 proceeds to stage 706 where the carton 204 is inserted into the container 202. For example, the carton 204 is inserted into the cavity formed by the front surface 304, the back surface 306, and the two side surfaces 308. During insertion of the carton 204 into the container 202, the fitment 208 is inserted into the landing 206 defined by the front surface 304.

From stage 706 where the carton 204 is inserted into the container 202, the method 700 proceeds to stage 708 where the container 202 is partially inserted into the beverage dispenser 100. For example, during stage 708 the alignment groove 310 may be used to align the container 202. The alignment may assist in guiding the fitment 208 into the proper location to engage the plumbing of the beverage dispenser 100.

From stage 708 where the container 202 is partially inserted into the beverage dispenser 100, the method 700 proceeds to stage 710 where the fitment 208 is caused to engage the beverage dispenser 100. For example, during insertion of the carton 204 into the beverage dispenser 100, pressure is applied to the protrusion 316. The pressure may be applied by the user as he or she presses against the protrusion 316. In addition, the pressure may be applied by a door of the beverage dispenser 100 as the container 202 is being secured within the beverage dispenser 100. Furthermore, a lever attached to the beverage dispenser 100 may engage the recess 312 and may apply pressure to the container 202. The pressure causes the fitment to engage the plumbing of the beverage dispenser 100. From stage 710 the method 700 terminates at termination block 712.

FIGS. 8*a*-8*j* illustrate a multi-view of another example of a cartridge 800 including a container 802 and a carton 804. Many of the possible aspects and features of the container 202 and the carton 204 discussed above are applicable to the container 802 and the carton 804 described below as well.

The carton 804 can be arranged and configured to fit within the container 802 as shown. The carton 804 contains a bag, pouch, bladder, or other flexible ingredient container (not shown) which stores beverage ingredients. The features of the flexible ingredient container are similar to those already described above. The carton 804 is illustrated and described in more detail with reference to FIGS. 12*a*-*g*, FIG. 13*a*, and FIG. 13*b*.

In one example, the flexible ingredient container may include a fitment 808. In the depicted example, the fitment 808 is shown in a landing position. The fitment 808 of the flexible ingredient container is designed to connect with plumbing inside the beverage dispenser 100 via a probe (not shown) to establish fluid communication between the beverage ingredients stored in the carton 804 and the nozzle 118. Many of the possible aspects and features of the fitment 808 are disclosed or are similar to the fitment 208 shown in FIGS. 2*a*-*i*.

In one example, the container 802 may be used to insert the carton 804 into the beverage dispenser 100. As shown in FIGS. 8*a*-8*i*, the container 802 includes a base surface 810, a front surface 812, a back surface 814, and two side surfaces 816. In one embodiment, the front surface 812, the back surface 814, and the two side surfaces 816 extend from the base surface 810 to define a cavity 806 sized to receive the carton 804. When the carton 804 is within the cavity 806, a spacing $S_1$ is defined between the carton 804 and the back surface 814 of the container 802. In the depicted example, the spacing $S_1$ is about 0.25 inches. It is to be understood that the spacing $S_1$ can vary with other embodiments. The cavity 806 further defines a spacing $S_2$ between the carton 804 and the two side surfaces 816 of the container 802. In the depicted example, the spacing $S_2$ is about 0.06 inches. It is to be understood that the spacing $S_2$ can vary with other embodiments.

In one embodiment, the container 802 has a length $L_1$. In the depicted embodiment, the length $L_1$ is about 10.5 inches. It is to be understood that the length $L_1$ of the container 802 can vary with other embodiments. The container 802 has a height $H_1$. In the depicted embodiment, the height $H_1$ is about 4.3 inches. It is to be understood that the height $H_1$ can vary with other embodiments. The container 802 has a width $W_1$. In the depicted embodiment, the width $W_1$ is about 1.6 inches. It is to be understood that the width $W_1$ can vary with other embodiments.

In other configurations, the dimensions of the container 802 can vary to hold cartons of differing sizes, as disclosed further below. In some embodiments, the container 802 may be made, at least in part, of a plastic material to allow the carton 804 to be visible. For example, the container 802 can be constructed of a clear material to permit a user to see a label on the carton 804. It is to be understood that other materials or laminates may be used to construct the container 802.

In certain examples, the container 802 includes a landing portion 818 located along top edges 820 of the two side surfaces 816. The landing portion 818 can be a flat planar surface that extends from the back surface 814 a length $L_2$ along the two side surfaces 816 of the container 802. In one example, the two side surfaces 816 each include a sloped portion 822 that extends a length $L_3$ from a distal end 824 of the landing portion 818 toward the front surface 812. In certain examples, the sloped portion 822 is constructed to extend downwardly at an angle $\alpha$ relative to the carton 804 such that the angle $\alpha$ increases in a direction D toward the front surface 812. In one example, the angle $\alpha$ can range between about 0 degrees to about 35 degrees from the distal end 824 of the landing portion 818 to the front surface 812. It is understood that the angle $\alpha$ can vary in other embodiments.

The landing portion 818 of the container 802 allows for the cartridge 800 to be properly positioned within the beverage dispenser 100. The landing portion 818 can engage an interior structure of the beverage dispenser 100 arranged and configured to provide downward force upon the cartridge 800 to better secure the cartridge 800 therein. Such an arrangement can help ensure that the cartridge 800 does not move within the beverage dispenser 100 or slide out of the beverage dispenser 100.

In one embodiment, the container 802 includes a protrusion 826 located at the back surface 814. The protrusion 826 can be defined as being formed from one unitary piece with the container 802. In other embodiments, the protrusion 826 can be coupled to the back surface 814 of the container 802 by other means such as fasteners or a weld mount. In the depicted embodiment, a length $L_4$ of the container 802 including the protrusion 826 located on the back surface 814 is about 10.8 inches. The protrusion 826 can extend from the back surface 814 a length $L_5$. In the depicted example, the length $L_5$ is about 0.33 inches. It is understood that the length $L_5$ may vary with other embodiments. Many of the possible aspects and features of the protrusion 826 are disclosed or are similar to the protrusion 316 shown in FIGS. 3*a-h*.

Figure 9:
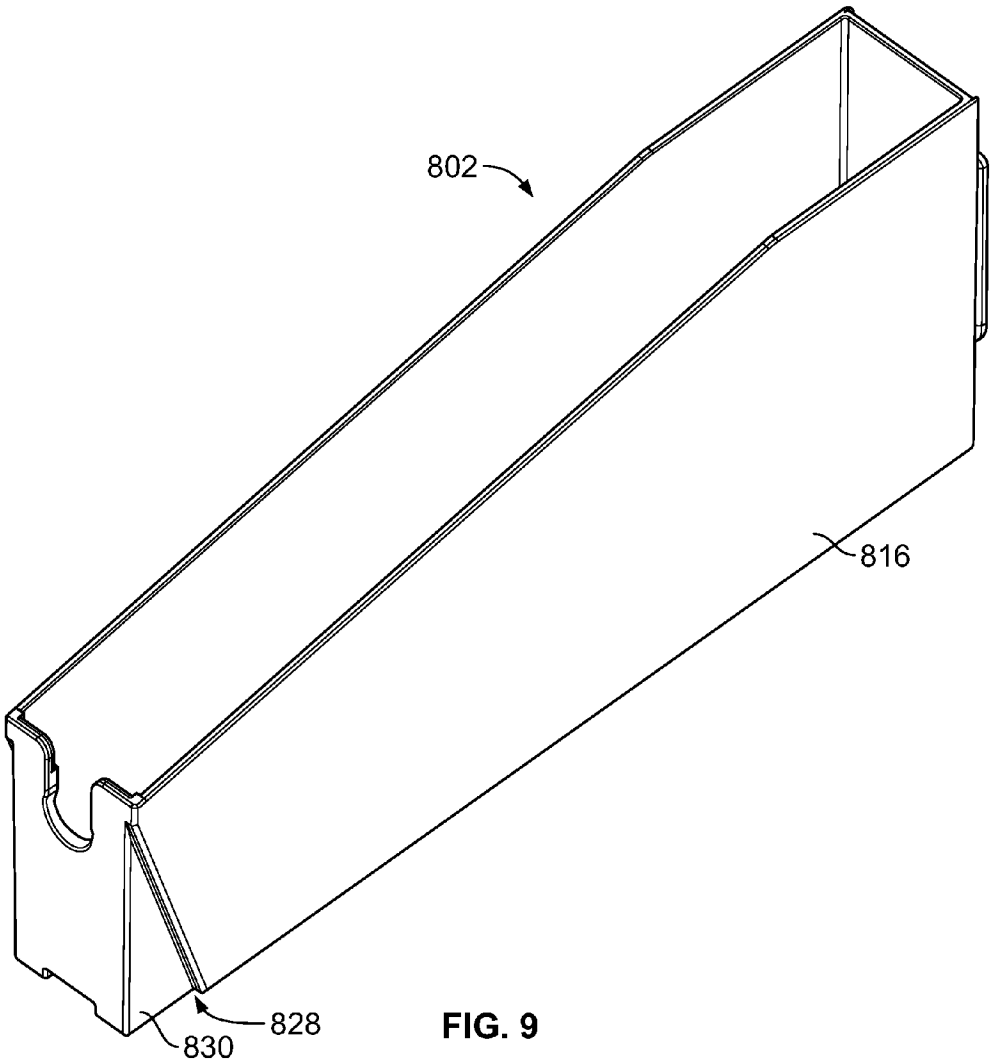
FIG. 9 shows a side perspective view of a container shown in FIG. 8*a*.

Referring to FIG. 9, features of the example container 802 are illustrated. FIG. 9 is a perspective view of the example container 802. The two side surfaces 816 of the container 802 can each define a recess 828 that forms a recessed surface 830 (shown for one of the two side surfaces). The recess 828 can be configured such that the carton 804 fits properly inside the container 802.

Figure 10:
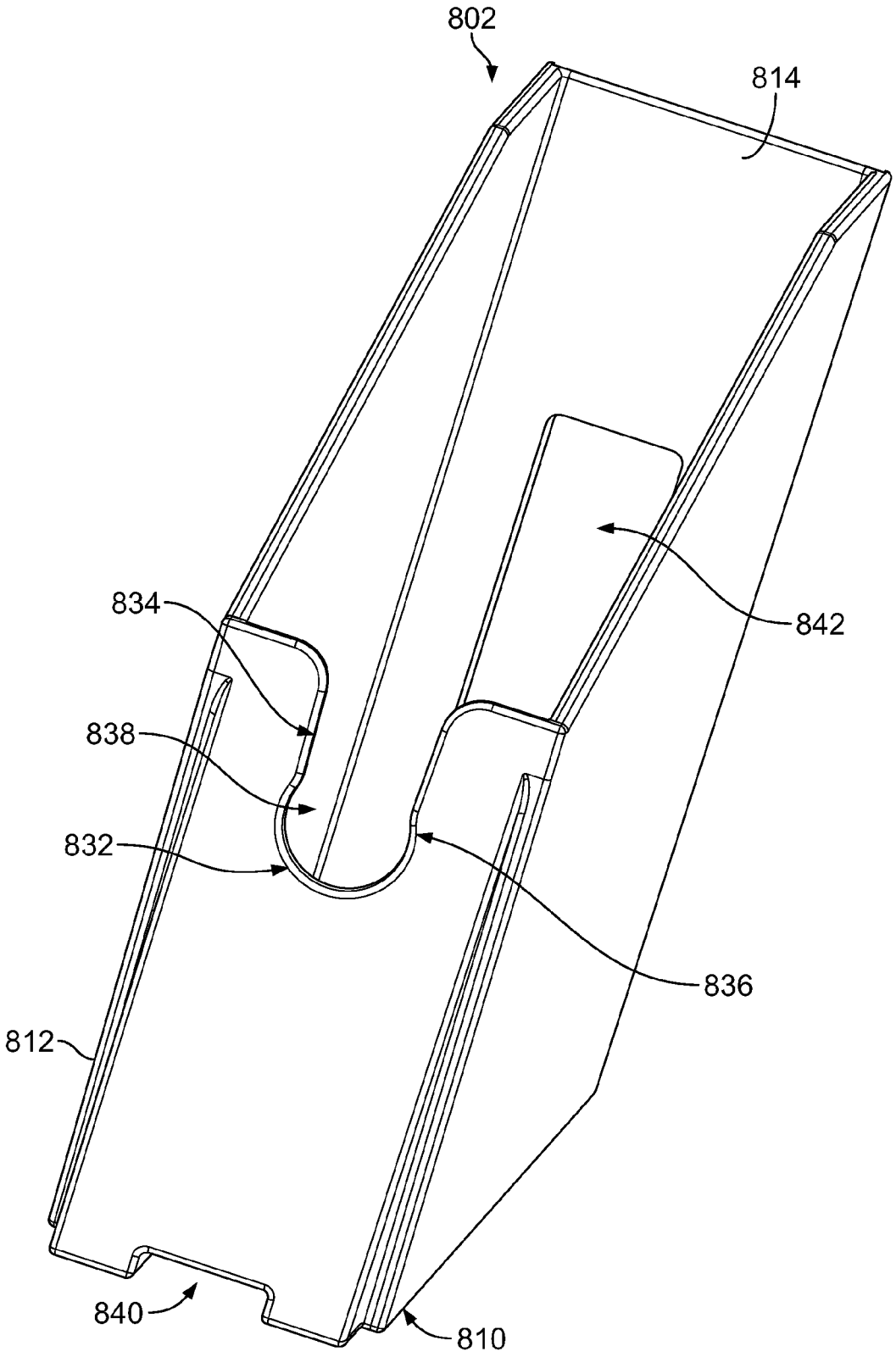
FIG. 10 is a front perspective view of the container shown in FIG. 9.

Referring to FIG. 10, the container 802 defines a landing 832 in the front surface 812 for receiving the fitment 808. In one example, the landing 832 can include an elongated slot 834 for guiding the fitment 808 into the landing 832. The landing 832 can include an oval shaped ring 836 formed below the elongated slot 834 where the fitment 808 can rest therein. The oval shaped ring 836 curves outwardly from a lower portion 838 of the elongated slot 834.

In one embodiment, the landing 832 may include a spring element or tab on either side of the landing 832 for securely holding the fitment 808 in the landing 832. In some embodiments, the spring element may apply a positive downward force on the fitment 808 or otherwise lock the fitment 808 in place so as to ensure proper seating and alignment of the fitment 808 within the container 802. Moreover, the fitment 808 may include a lip or flange that engages with a front surface of the container 802 about the landing 832 so as to prevent the fitment 808 from passing through the landing 832.

The fitment 808 connects with plumbing inside the beverage dispenser 100 via a probe 831 to establish fluid communication between the beverage ingredients stored in the carton 804 and the nozzle 118. Generally, the probe 831 may be inserted into the fitment 808 and engage with and open a plug 833 of the fitment 808, thereby establishing a fluid pathway for the beverage ingredients within the pouch 837 through the probe and on to the nozzle 118. See FIG. 8J. Many of the possible aspects and features of the landing 832 are disclosed or are similar to the landing 206 shown in FIGS. 2*a-j* and FIGS. 3*a-h*.

The base surface 810 may define an alignment groove 840. The alignment groove 840 extends from the front surface 812 to the back surface 814. The alignment groove 840 may extend completely from the front surface 812 to the back surface 814. In other embodiments, the alignment groove 840 may extend any length of the base surface 810. In addition, the alignment groove 840 may begin at any location along the base surface 810 and extend for any length of the base surface 810. For example, the alignment groove 840 may begin at a midpoint location long the base surface 810 and extend a quarter length of the base surface 810. In addition, multiple alignment grooves may be defined by the base surface 810.

The back surface 814 defines an opening 842. The opening 842 is sized to allow the carton 804 (see FIGS. 8*a-i*) to be visible when the carton 804 is located within the container 802. In one embodiment, the protrusion 826 (see FIGS. 8*a-i*) surrounds the opening 842 without substantially obscuring visibility of the carton 804.

Figure 11:
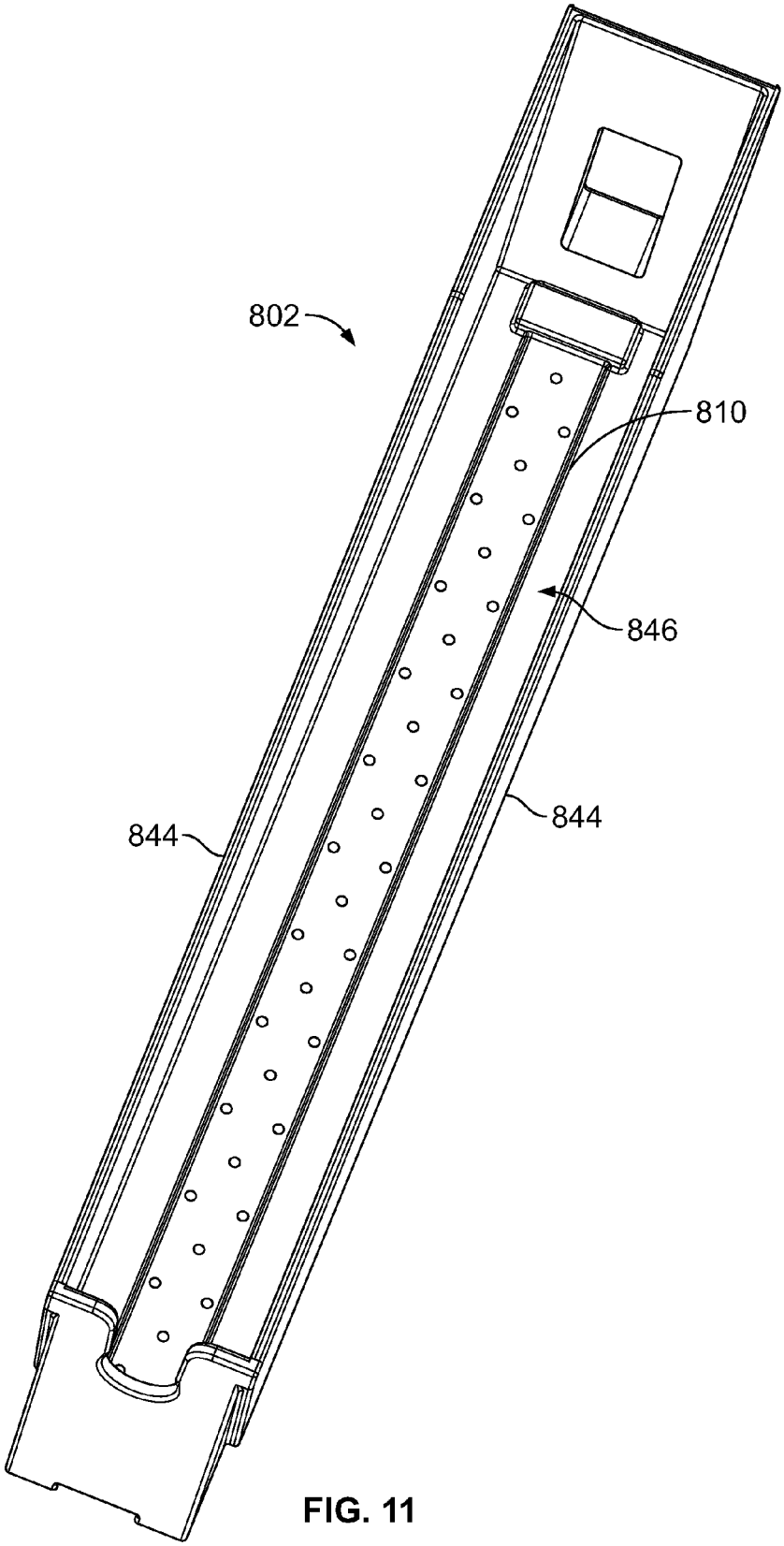
FIG. 11 is a top perspective view of the container shown in FIG. 9.
Figure 12A:
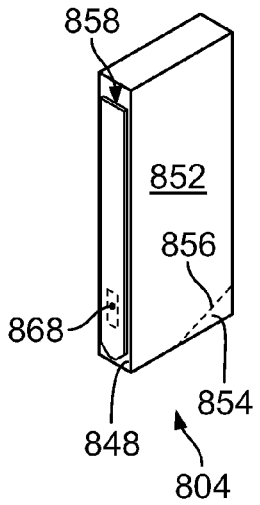
FIG. 12*a* shows a left perspective view of another carton in accordance with the principles of the present disclosure.
Figure 12B:
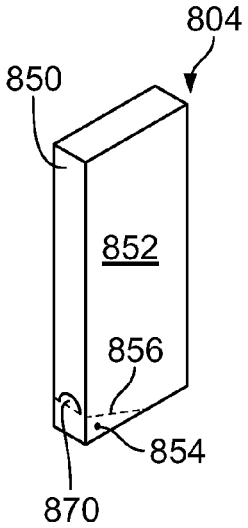
FIG. 12*b* shows a right perspective view of the carton of FIG. 12*a*.
Figure 12C:
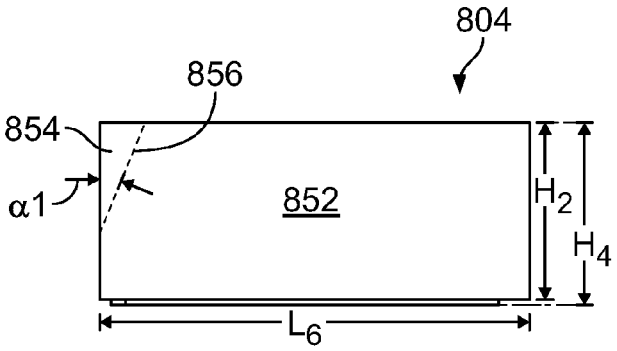
FIG. 12*c* shows a right side perspective view of the carton of FIG. 12*a*.
Figure 12D:
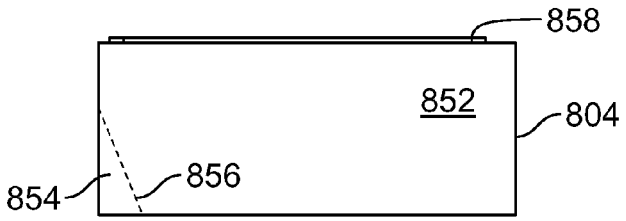
FIG. 12*d* shows a left side perspective view of the carton of FIG. 12*a*.
Figure 12E:
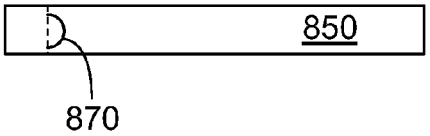
FIG. 12*e* shows a bottom view of the carton of FIG. 12*a*.
Figure 12F:
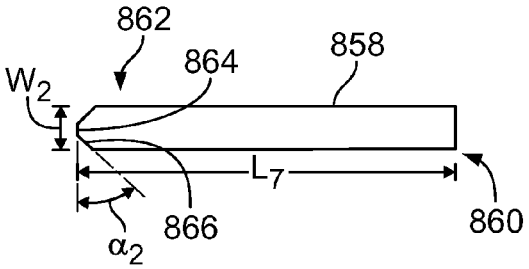
FIG. 12*f* shows a top view of a protective layer in accordance with the present disclosure.
Figure 12G:
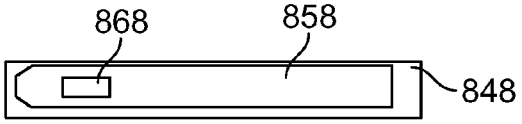
FIG. 12*g* shows a top view of the carton of FIG. 12*a*.

Referring to FIG. 11, a top view of the container 802 is shown. The base surface 810 is shown including a plurality of bumps 844 disposed along an interior surface 846 of the base surface 810. In one embodiment, the bumps 844 may help provide a vacuum break. If liquid drips into the bottom of the container 802, the bumps 844 may keep the carton 804 from setting in the liquid.

FIGS. 12*a-g* and FIGS. 13*a-b* show a multi-view of the carton 804. In some embodiments, the carton 804 may be made, at least in part, of paperboard, cardboard, honeycomb board, or other inexpensive and relatively available materials. Other materials or laminates may be used to construct the carton 804.

In one embodiment, the carton 804 can include a top surface 848, a bottom surface 850, and two major surfaces 852. The carton 804 has a length $L_6$. In the depicted example, the length $L_6$ is about 9.9 inches. It is to be understood that the length $L_6$ can vary with other embodiments. The carton 804 has a height $H_2$. In the depicted example, the height $H_2$ is about 4 inches. It is to be understood that the height $H_2$ can vary with other embodiments.

Other dimensions for the carton are possible. For example, in another embodiment, the length is approximately 11.5 inches, the height is approximately 4.6 inches, and the width is approximately 1.6 inches. In yet another embodiment, the carton dimensions are approximately 16.4 inches by 4 inches by 1.3 inches.

In certain embodiments, the carton 804 includes a tear away section 854. The tear away section 854 includes dotted lines for tearing out the tear away section 854 to form an angled surface 856. The tear away section 854 covers and protects the fitment 808 (see FIGS. 8*a-i*) during delivery and handling of the beverage ingredients. When the tear away section 854 is torn away from the carton 804 to form the angled surface 856, the fitment 808 is exposed. The dotted lines of the tear away section 854 may be a perforated line. The perforation allows the tear away section 854 to be torn from the carton 804. The tear away section 854 can be torn away at an angle $\alpha_1$ from the carton 804. In the depicted embodiment, the angle $\alpha_1$ can be about 21 degrees. It is to be understood that the angle $\alpha_1$ can vary with other embodiments.

When the tear away section 854 is removed the carton 804, the carton 804 can fit inside the container 802 to abut the recess 828. The shape of the tear away section 854 may correspond to the shape of the recess 828. Specifically, once the tear away section 854 is removed from the carton 804, the angle $\alpha_1$ of the carton 804 complements the angle formed by the recess 828 so that the carton 804 fits within the container 802. This assures that the carton 804 is properly oriented when inserted into the container. For example, if the carton 804 was flipped upside down and inserted in to the container 802, the recess 828 would contact the carton 804 before it could be fully inserted into the container 802. A similar result would occur if the carton 804 was reversed.

In another embodiment, the tear away section 854 may be attached to the carton 804 using other mechanisms, such as with an adhesive.

It should be understood that while the carton and containers (discussed above) are generally shown with a vertical orientation, they may also be modified to have a horizontal orientation without departing from the spirit or scope of the various embodiments described herein.

In certain embodiments, the bottom surface 850 can include an oval shaped portion 870 therein. The oval shaped portion 870 allows the user to easily grasp and remove the tear away section 854.

The carton 804 includes a protective layer 858 on the top surface 848. The protective layer 858 can be adhered to the top surface 848 by, for example, adhesive. The protective layer 858 has a length $L_7$. In the depicted example, the length $L_7$ can be about 9.0 inches. It is to be understood that the length $L_7$ can vary with other embodiments. The protective layer 858 has a width $W_2$. In the depicted example, the width $W_2$ can be about 1.0 inch. It is to be understood that the width $W_2$ can vary with other embodiments. When the protective layer 858 is adhered to the carton 804, the carton 804 can have a height $H_4$.

The protective layer 858 has a distal end 860 and a proximal end 862. In certain examples, the proximal end 862 can have a flat portion 864 and sides 866 that taper adjacent to the flat portion 864. The sides 866 can taper at an angle $\alpha_2$ from the flat portion 864. In the depicted example, the angle $\alpha_2$ is about 45 degrees. It is to be understood that the angle $\alpha_2$ can vary with other embodiments.

In certain embodiments, the carton 804 includes a radio frequency identification (RFID) chip 868. The RFID chip 868 may be attached to an interior or exterior surface of the carton 804. For example, as shown in FIGS. 12*a-g*, the RFID chip 868 may be attached to the protective layer 858. The RFID chip 868 can be attached anywhere along the protective layer 858. In some embodiments, the RFID chip 868 may be attached to an interior surface of the carton 804.

In other embodiments, the RFID chip 868 may be embedded within a surface of the carton 804. For example, the exterior surface may include a recess that may allow the RFID chip 868 to be flush with the exterior surface. Moreover, the RFID chip 868 may be embedded within the exterior surface and covered. The covering may be made of the same material the carton 804 or made of a different material. The covering protects the RFID chip 868. Many of the possible aspects and features of the RFID chip 868 are disclosed or are similar to the RFID chip 406 shown in FIGS. 4*a-f*. Accordingly, the descriptions and features of this structure are not repeated here for the RFID chip 868.

Figure 13B:
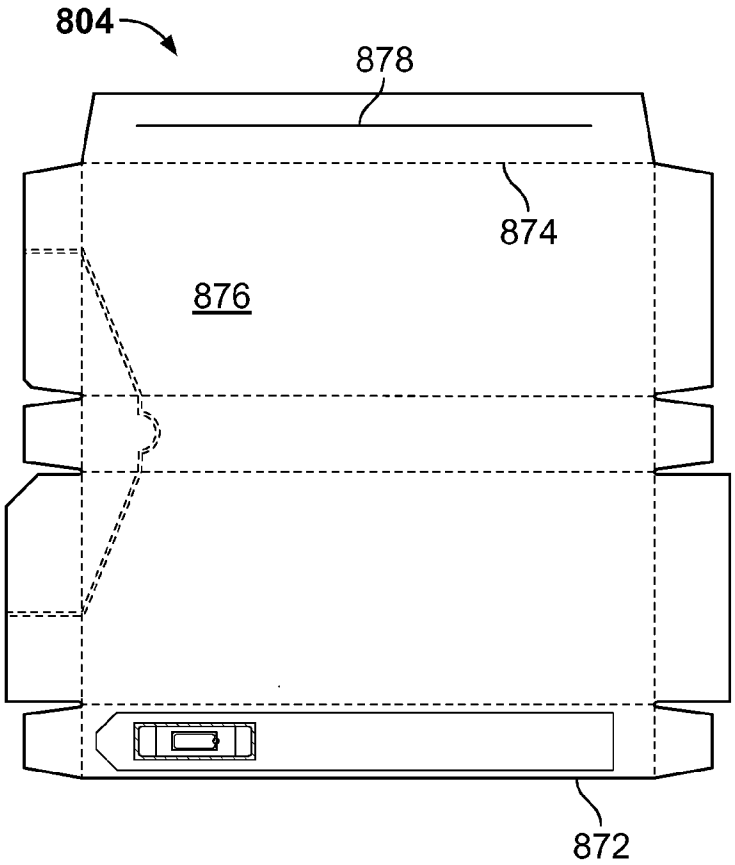
FIG. 13*b* shows an opposite side of the outline of FIG. 13*a*.
Figure 13A:
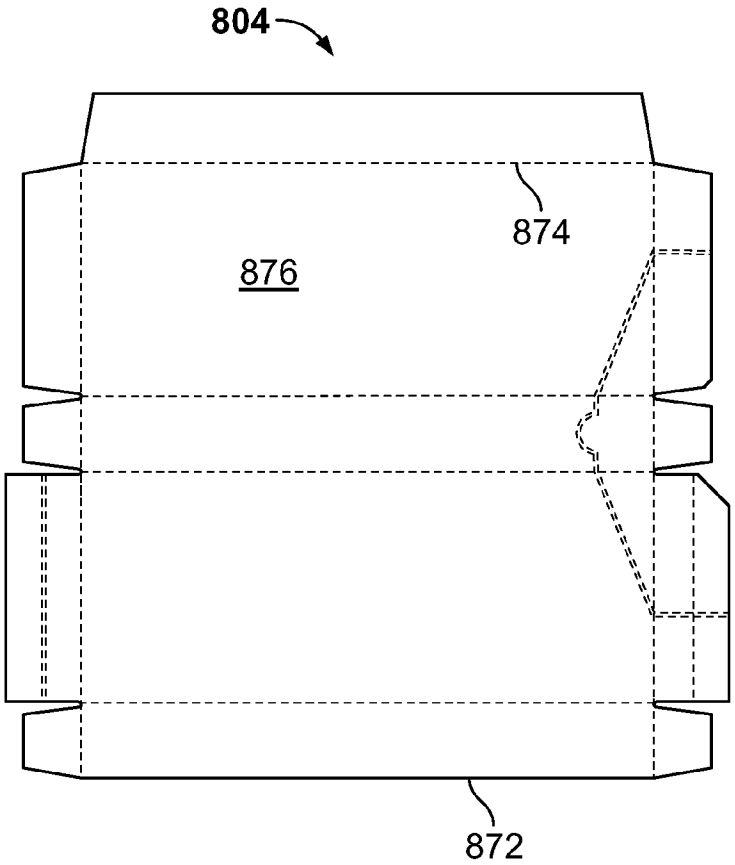
FIG. 13*a* shows one side of an outline of the carton of FIG. 12*a* cut from a flat stock.

Referring to FIGS. 13*a-b*, an outline 872 of the carton 804 can be stamped from a flat stock. In other embodiments, the outline 872 of carton 804 can be cut from a flat stock. The outline 872 of the carton 804 can include fold lines 874 that are scored on a surface 876 of the flat stock once the outline 872 has been cut. In some examples, an adhesive striping 878 is applied. The adhesive striping 878 can be used after folding the flat stock along the fold lines 874 to form an enclosure.

Figure 14B:
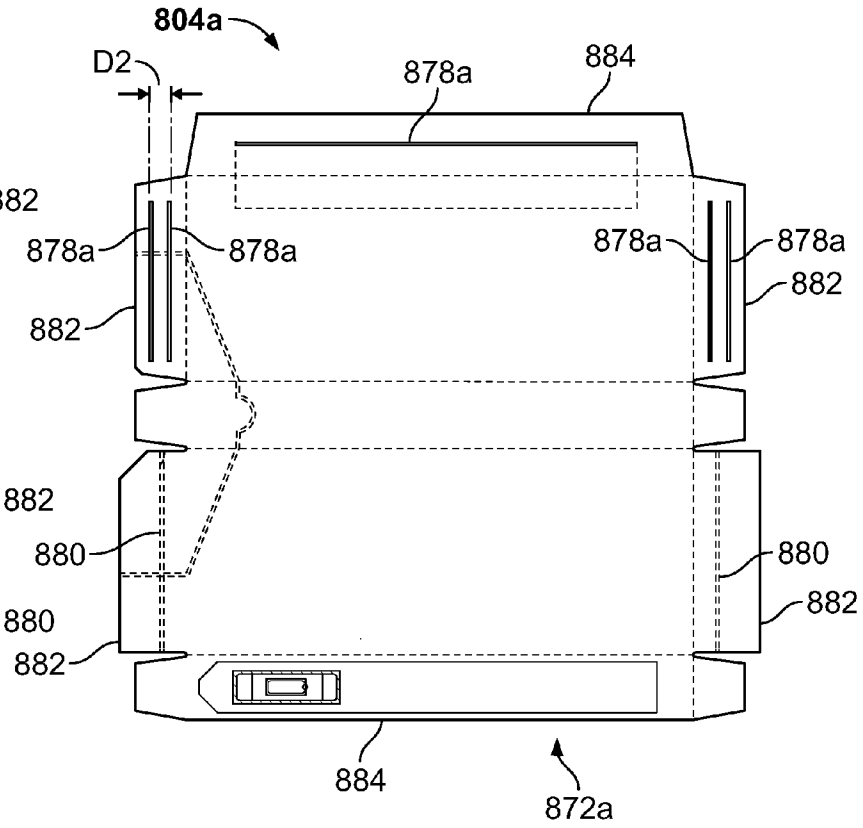
FIG. 14*b* shows an opposite side of the outline of FIG. 14*a*.
Figure 14A:
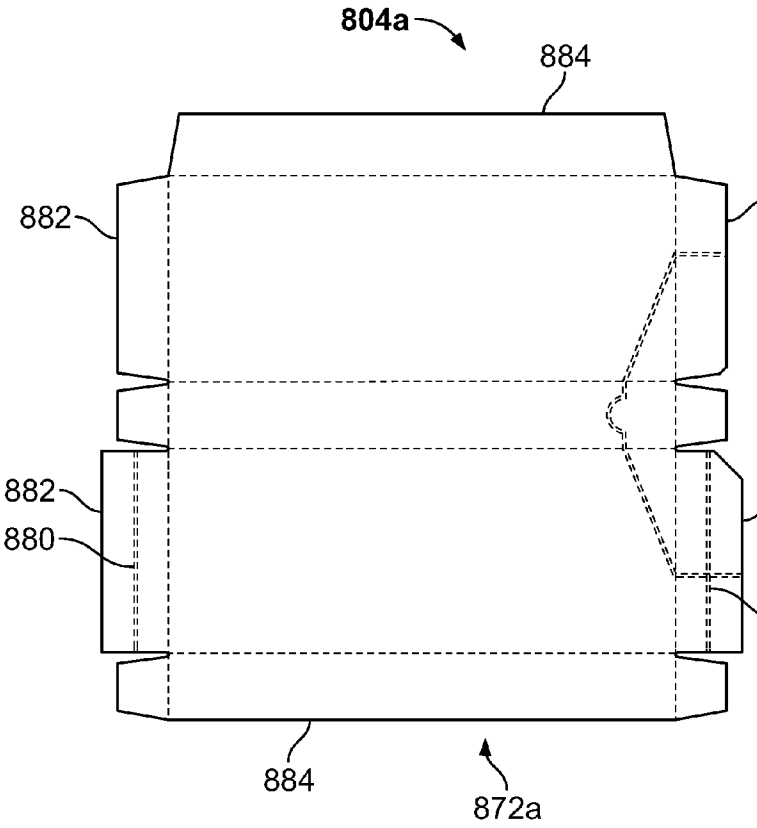
FIG. 14*a* shows one side of another outline of the carton of FIG. 12*a* cut from a flat stock.
Figure 15B:
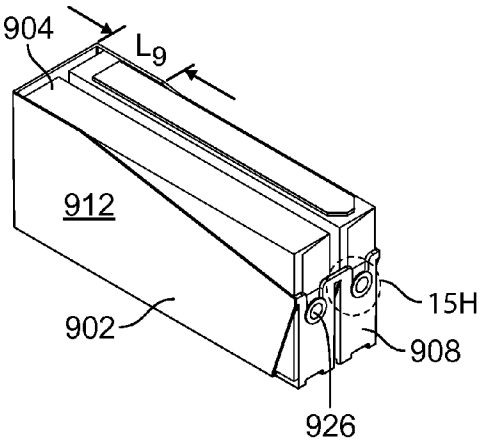
FIG. 15*b* shows a front view of the double cartridge of FIG. 15*a*.
Figure 15D:
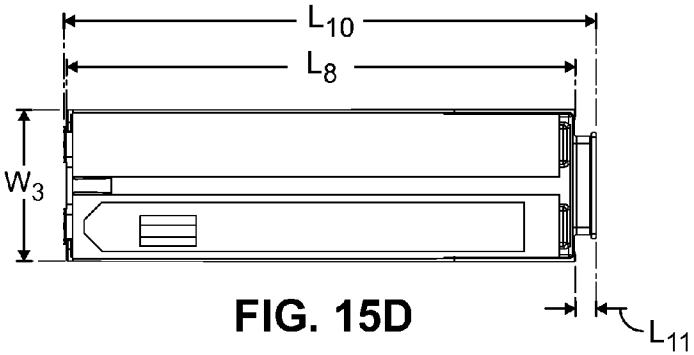
FIG. 15*d* shows a top view of the double cartridge of FIG. 15*a*.
Figure 15A:
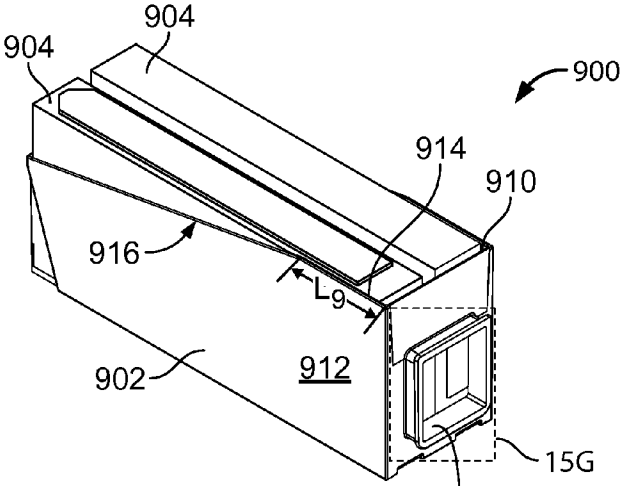
FIG. 15*a* shows a rear view of a double cartridge in accordance with the principles of the present disclosure.
Figure 15C:
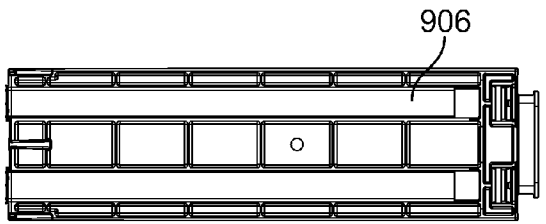
FIG. 15*c* shows a bottom view of the double cartridge of FIG. 15*a*.
Figure 15F:
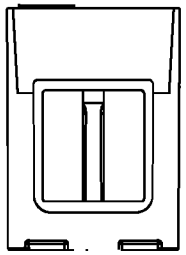
FIG. 15*f* shows a rear view of the double cartridge of FIG. 15*a*.
Figure 15H:
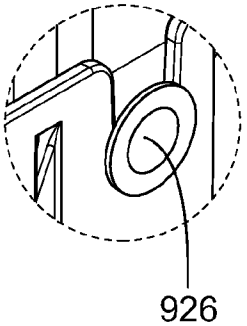
FIG. 15*h* shows an enlarged portion of FIG. 15*b*.
Figure 15E:
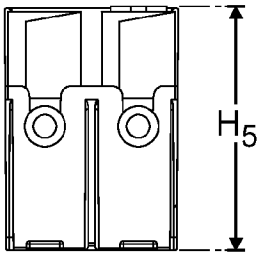
FIG. 15*e* shows a front view of the double cartridge of FIG. 15*a*.
Figure 15G:
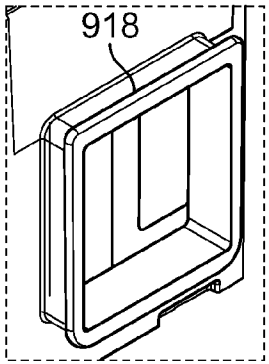
FIG. 15*g* shows an enlarged portion of FIG. 15*a*.

Referring to FIGS. 14*a-b*, another example of an outline 872*a* of the carton 804*a* is shown. In the depicted example, there is a tamper evidence perforation 880 on minor flaps 882 of the carton 804*a*. The tamper evidence perforation 880 is constructed to tear upon opening of the carton 804*a*. The tamper evidence perforation 880 can provide evidence of whether or not the carton 804*a* has been tampered with.

In one embodiment, two glue lines 878*a* are applied on the minor flaps 882 of the carton 804*a*. The tamper evidence perforation 880 is aligned such that one of the two glue lines 878*a* is on either side of the tamper evidence perforation 880. For example, the two glue lines 878*a* can be spaced a distance $D_2$ apart such that the tamper evidence perforation 880 lies between the two glue lines 878*a* when the carton 804*a* is closed. In one example, the distance $D_2$ may be 0.5 inches. It is to be understood that the $D_2$ can vary with other embodiments. In certain embodiments, a single glue line may be applied on a major flap 884 of the carton 804*a*.

Other mechanisms can be used to indicate tampering of the carton. For example, in certain alternative embodiments, tamper evident tape (not shown) may be applied across the tamper evidence perforation 880 for further tamper evidence.

Referring to FIGS. 15*a-h*, a multi-view of another example of a cartridge 900 including a container 902 and cartons 904 is shown. In the depicted embodiment, the container 902 is sized to receive two cartons 904. It is understood that the number of cartons 904 in the container 902 can vary with other embodiments. In one example, the container 902 may have two pouches, one in each of the cartons 904. Alternatively, instead of two of the cartons 904, the container 902 may accept a single carton that has the capacity to hold the volume of two pouches. Many of the possible aspects and features of the container 802 and the carton 804 discussed above are applicable to the container 902 and the carton 904 described below as well.

In certain embodiments, the container 902 includes a base surface 906, a front surface 908, a back surface 910, and two side surfaces 912. The front surface 908, back surface 910, and two side surfaces 912 extend from the base surface 906 and may define a cavity sized to receive the two cartons 904. The container 902 has a length $L_8$. In the depicted embodiment, the length $L_8$ is about 10.5 inches. It is to be understood that the length $L_8$ of the container 902 can vary with other embodiments. The container 902 has a height $H_5$. In the depicted embodiment, the height $H_5$ is about 4.4 inches. It is to be understood that the height $H_5$ can vary with other embodiments. The container 902 has a width $W_3$. In the depicted embodiment, the width $W_3$ is about 3.3 inches. It is to be understood that the width $W_3$ can vary with other embodiments.

In certain examples, the container 902 includes a landing portion 914 located along the two side surfaces 912. The landing portion 914 can be a flat planar surface that extends from the back surface 910 a length $L_9$ along the two side surfaces 912 of the container 902. The landing portion 914 of the container 902 allows for the cartridge 900 to be properly positioned within the beverage dispenser 100. The landing portion 914 can engage an interior structure of the beverage dispenser 100 arranged and configured to provide downward force upon the cartridge 900 to better secure the cartridge 900 therein.

In one embodiment, the container 902 includes a protrusion 918 located at the back surface 910. The protrusion 918 can be defined as being formed from one unitary piece with the container 902. In other embodiments, the protrusion 918 can be coupled to the back surface 910 of the container 902 by other means such as fasteners or a weld mount. In the depicted embodiment, a length $L_{10}$ of the container 902 including the protrusion 918 located on the back surface 910 is about 10.6 inches. The protrusion 918 can extend from the back surface 910 a length $L_{11}$. In the depicted example, the length $L_{11}$ is about 0.33 inches. It is understood that the length $L_{11}$ may vary with other embodiments. Many of the possible aspects and features of the protrusion 918 are disclosed or are similar to the protrusion 826 shown in FIGS. 8*a-i*. Accordingly, the descriptions and features of these structures are not repeated here for the protrusion 918.

Figure 16:
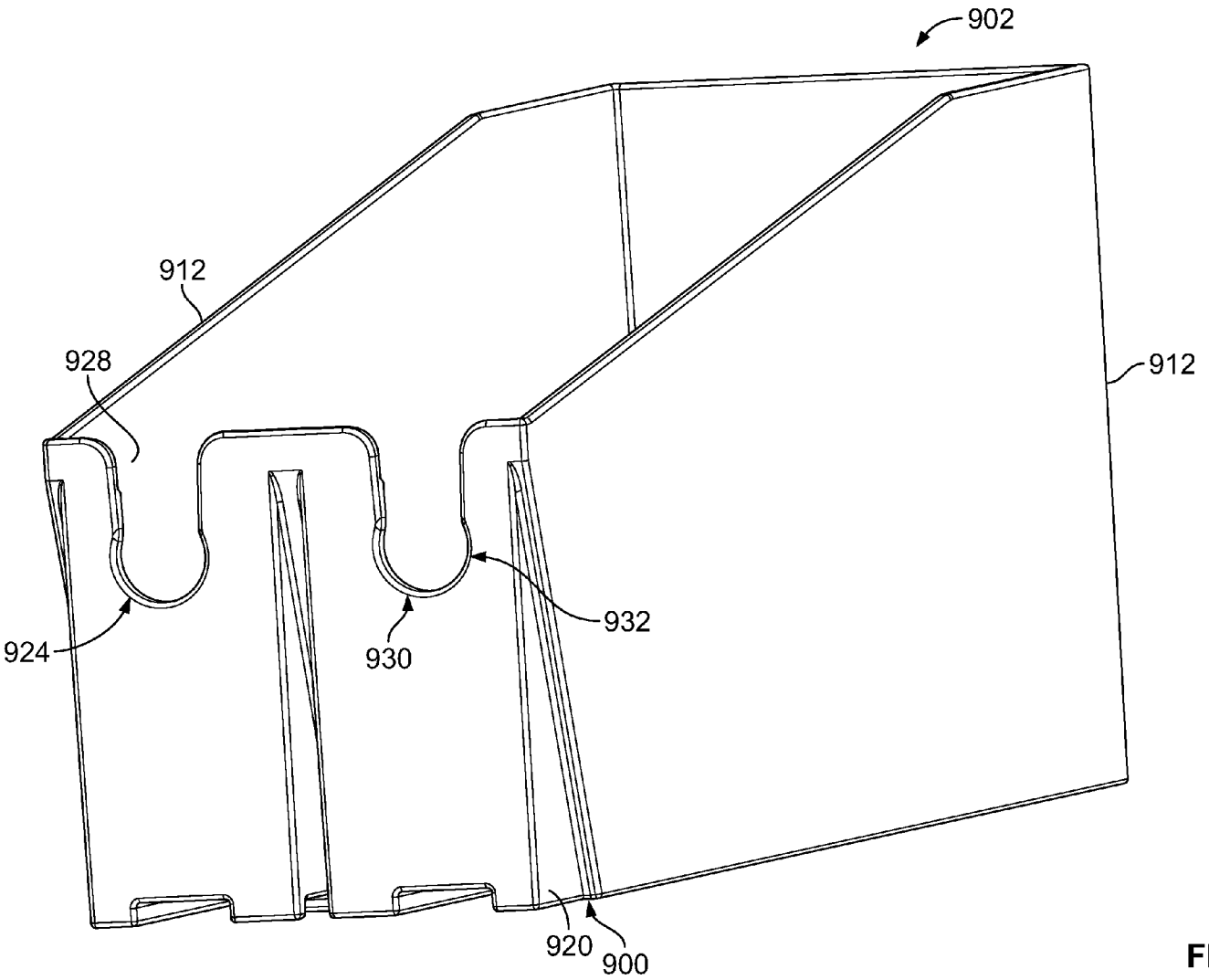
FIG. 16 shows a front perspective view of a container shown in FIG. 15*a*.

Referring to FIG. 16, features of the example container 902 are illustrated.

FIG. 16 is a perspective view of the example container 902. The two side surfaces 912 of the container 902 can each define a recess 920 that forms a recessed surface 922 (shown for one of the two side surfaces). The recess 920 can be configured such that the cartons 904 fit properly inside the container 902.

The container 902 defines a landing 924 in the front surface 908 for receiving a fitment 926 (see FIGS. 14*a-h*). In one example, the landing 924 can include an elongated slot 928 for guiding the fitment 926 into the landing 924. The landing 924 can include an oval shaped ring 930 formed below the elongated slot 928 where the fitment 926 can rest therein. The oval shaped ring 930 curves outwardly from a lower portion 932 of the elongated slot 928. Many of the possible aspects and features of the landing 924 and fitment 926 are disclosed or are similar to the landing 832 and fitment 808 shown in FIGS. 8*a-i* and FIG. 10. Accordingly, the descriptions and features of these structures are not repeated here for the landing 924 and fitment 926.

Figure 17:
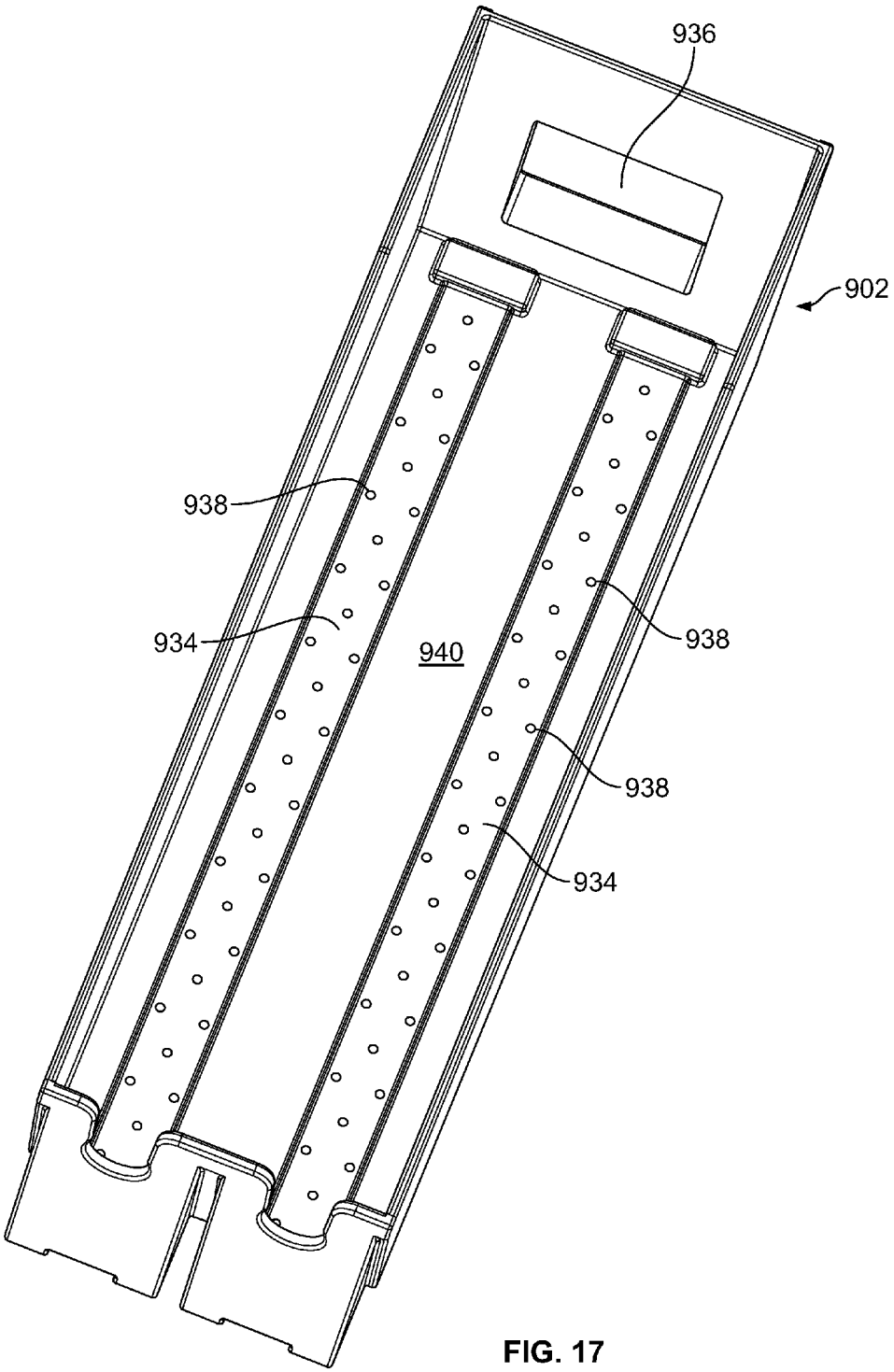
FIG. 17 shows a top perspective view of the container shown in FIG. 15*a*.

Referring to FIG. 17, a top view of the container 902 is shown. In one embodiment, the base surface 906 may define alignment grooves 934. The alignment grooves 934 extend from the front surface 908 to the back surface 910. The alignment grooves 934 may extend completely from the front surface 908 to the back surface 910. In other embodiments, the alignment grooves 934 may extend any length of the base surface 906. In addition, the alignment grooves 934 may begin at any location along the base surface 906 and extend for any length of the base surface 906.

The back surface 910 defines an opening 936. The opening 936 is sized to allow the cartons 904 (see FIGS. 15*a-h*) to be visible when the cartons 904 are located within the container 902. In one embodiment, the protrusion 918 (see FIGS. 15*a-h*) surrounds the opening 936 without substantially obscuring visibility of the cartons 904. The base surface 906 is shown including a plurality of bumps 938 disposed along an interior surface 940 of the base surface 906.

Figure 18:
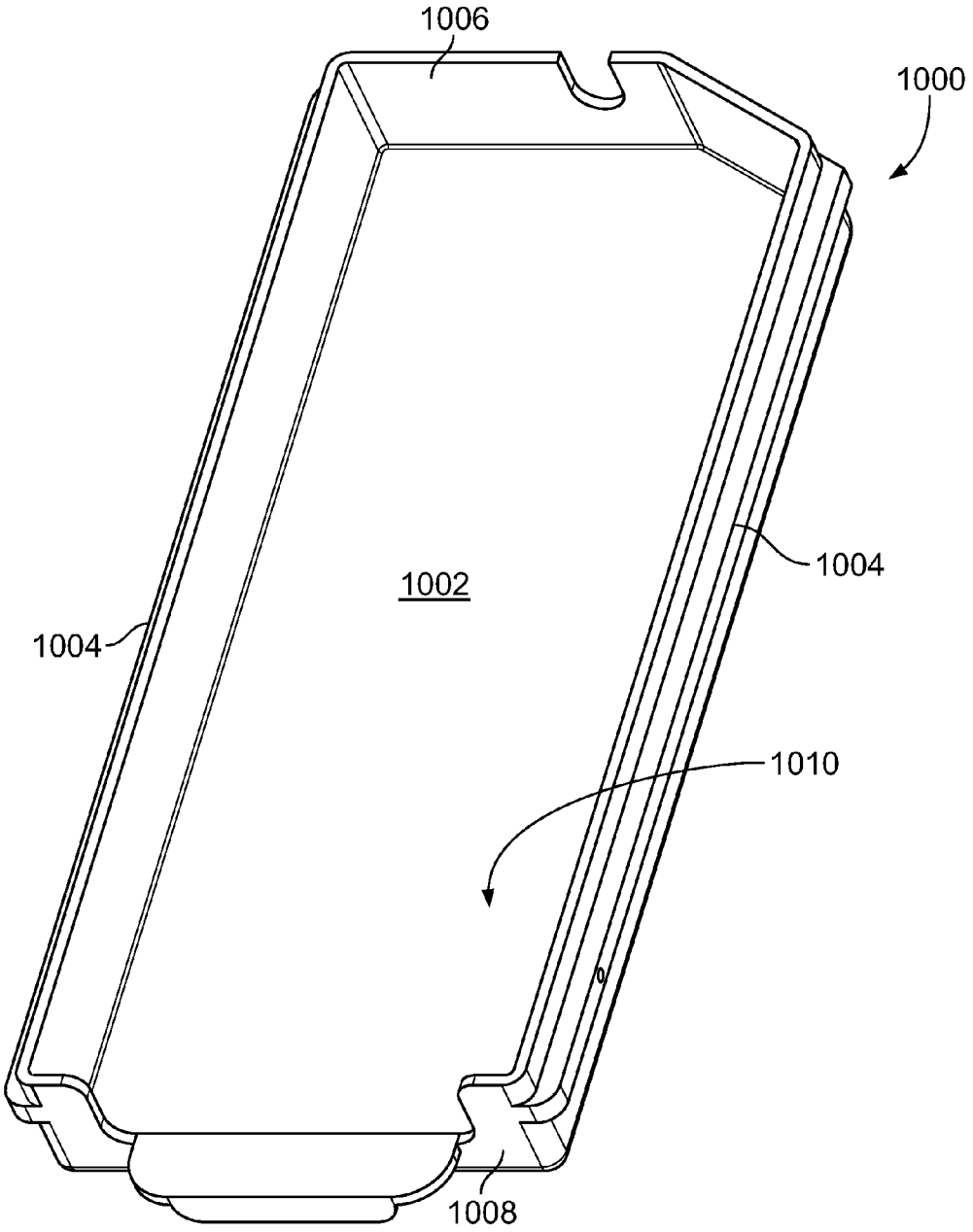
FIG. 18 shows a perspective view of another container in accordance with the principles of the present disclosure.

Referring to FIG. 18, a perspective view of another embodiment of a container 1000 is shown. The container 1000 can include a base 1002, two sides 1004, a front surface 1006, and a rear surface 1008. The two sides 1004, the front surface 1006, and the rear surface 1008 can extend from the base 1002 to define a cavity 1010. In some examples, the container 1000 can be arranged and configured as a tray.

Figure 19C:
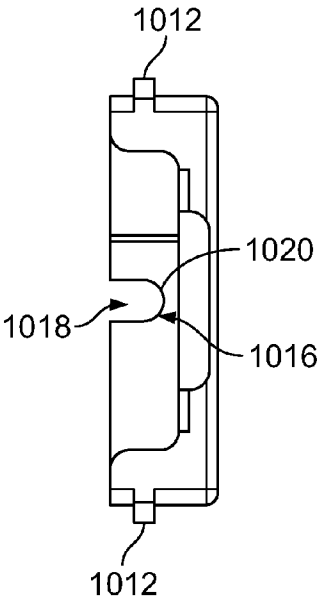
FIG. 19*c* shows a top view of the container of FIG. 19*a*.
Figure 19A:
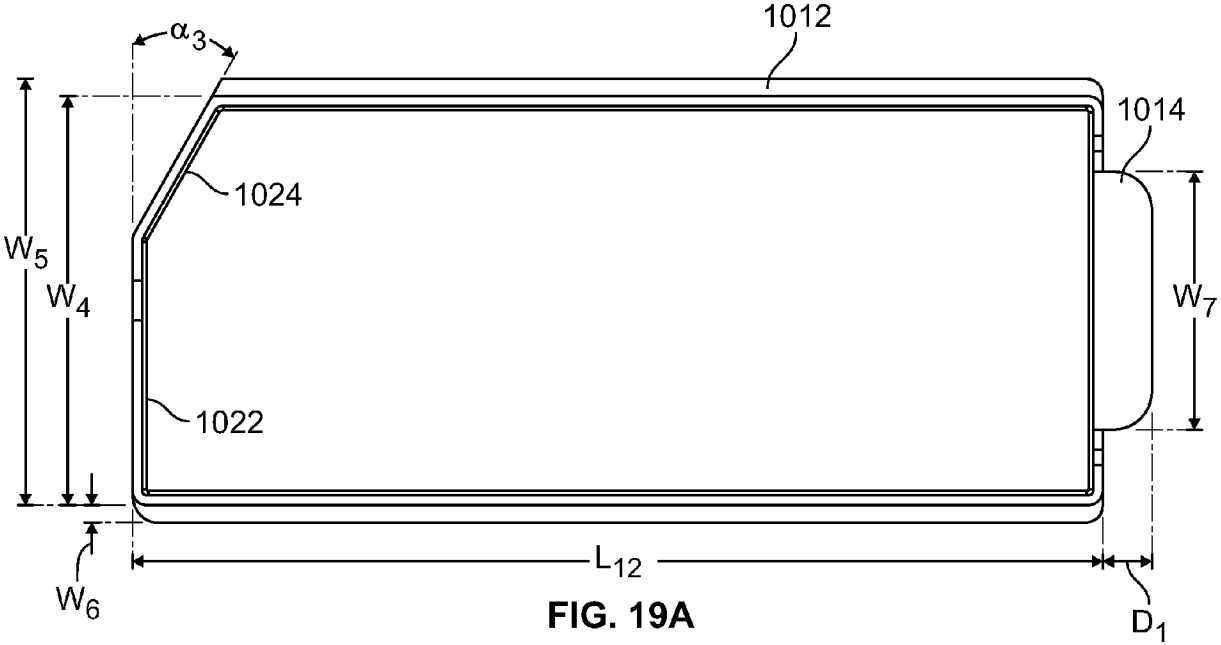
FIG. 19*a* shows a top planar view of the container shown in FIG. 18
Figure 19B:
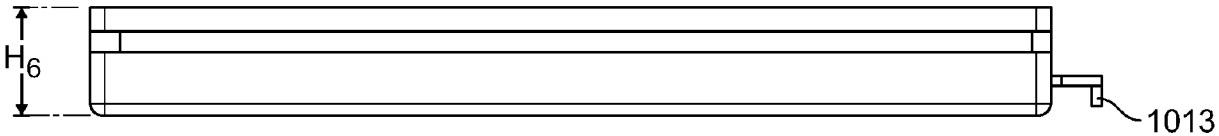
FIG. 19*b* shows a side view of the container of FIG. 19*a*.
Figure 20A:
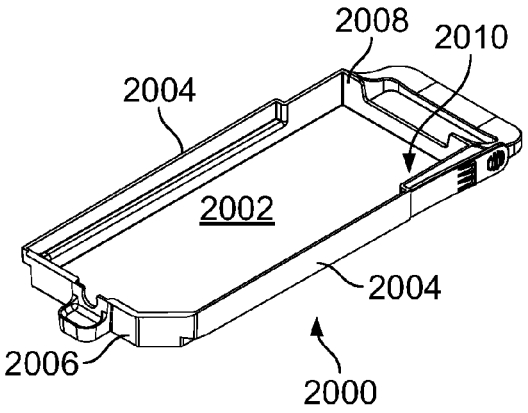
FIG. 20*a* shows a perspective view of another container in accordance with the principles of the present disclosure.
Figure 20B:
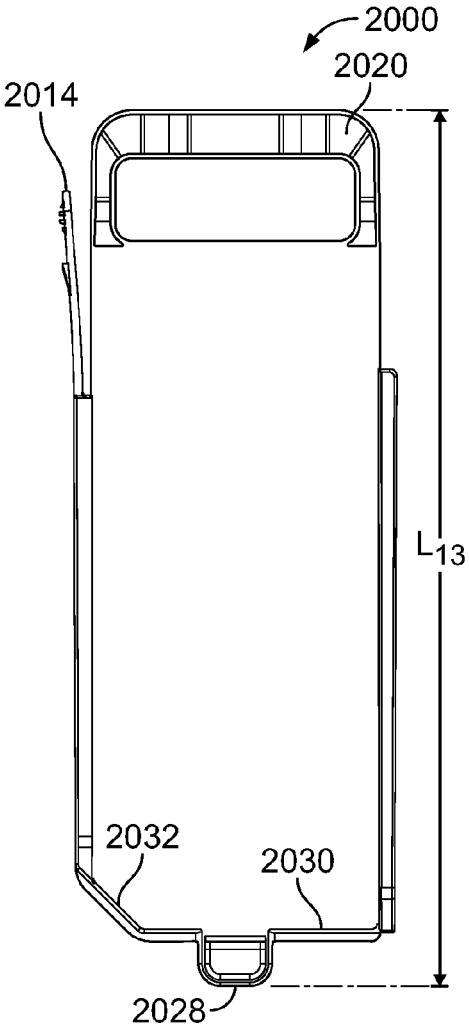
FIG. 20*b* shows a bottom view of the container of FIG. 20*a*.
Figure 20C:
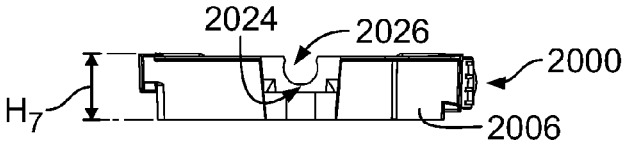
FIG. 20*c* shows a front view of the container of FIG. 20*a*.
Figure 20D:
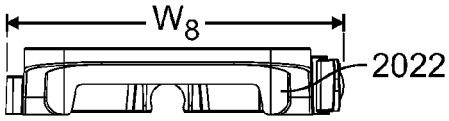
FIG. 20*d* shows a rear view of the container of FIG. 20*a*.
Figure 20G:
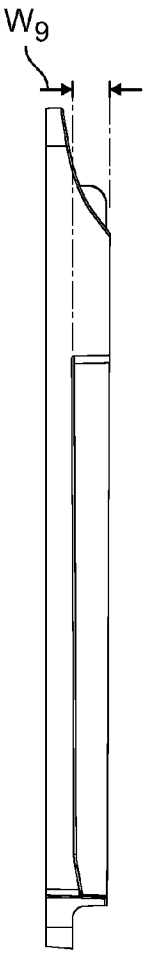
FIG. 20*g* shows a left side view of the container of FIG. 20*a*.
Figure 20F:
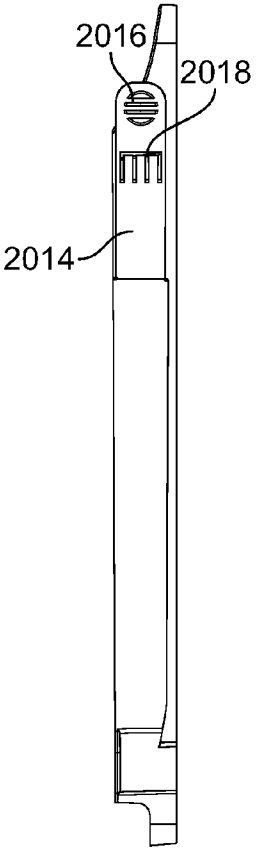
FIG. 20*f* shows a right side view of the container of FIG. 20*a*.
Figure 20E:
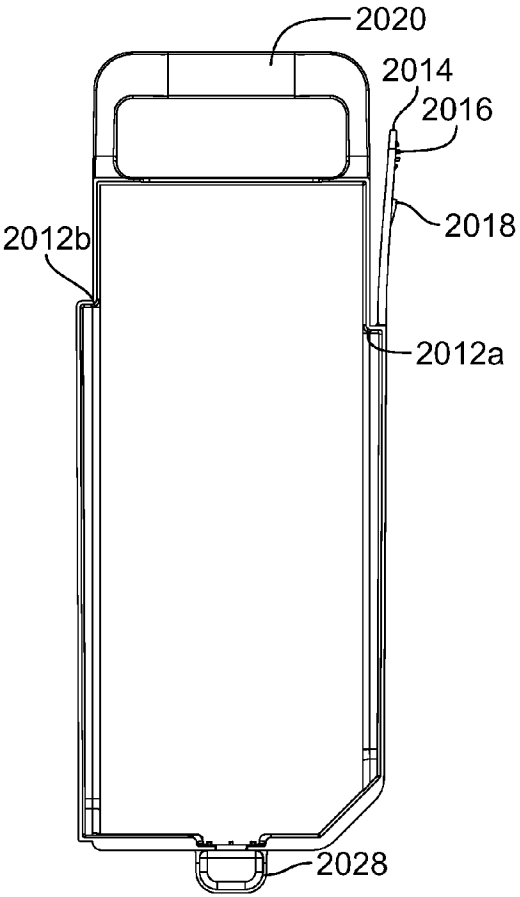
FIG. 20*e* shows a top view of the container of FIG. 20*a*.
Figure 21A:
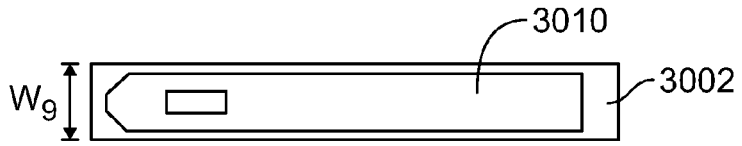
FIG. 21*a* shows a top view of another carton in accordance with the principles of the present disclosure.
Figure 21B:
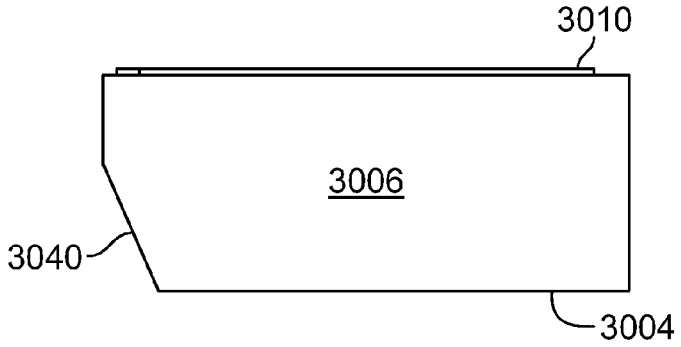
FIG. 21*b* shows a left side view of the carton of FIG. 21*a*.
Figure 21C:
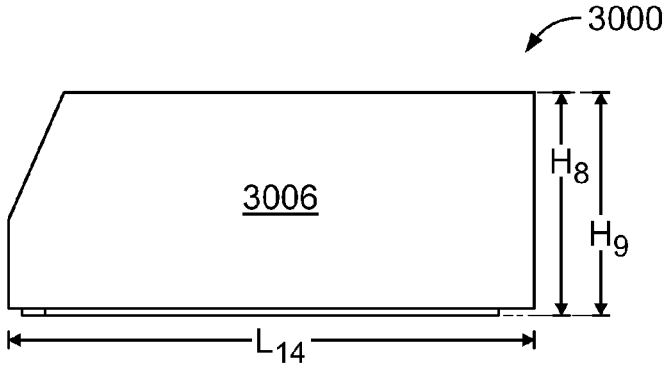
FIG. 21*c* shows a right side view of the carton of FIG. 21*a*.
Figure 21D:
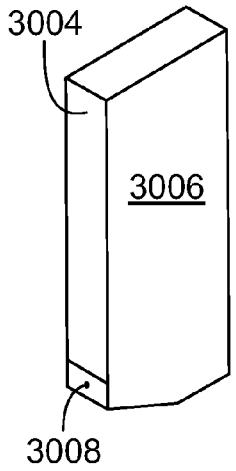
FIG. 21*d* shows a right perspective view of the carton of FIG. 21*a*.
Figure 21E:
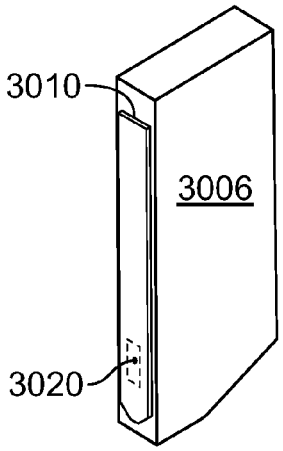
FIG. 21*e* shows a left perspective view of the carton of FIG. 21*a*.
Figure 21F:
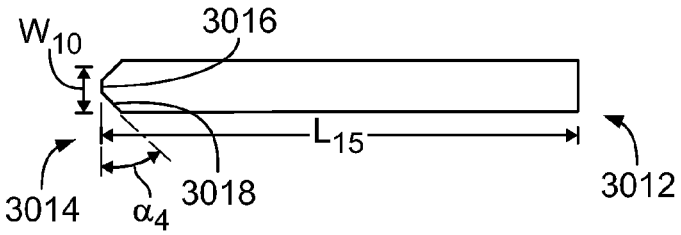
FIG. 21*f* shows a top view of another protective layer in accordance with the present disclosure.

Referring to FIGS. 19*a-c*, a multi-view of the container 1000 is depicted.

The container 1000 can be arranged and configured to hold a bag, pouch, bladder, or other flexible ingredient container (not shown) which stores beverage ingredients. In one example, the flexible ingredient container may include a fitment (not shown). The features of the flexible ingredient container and fitment are similar to those already described above.

In one embodiment, the container 1000 has a length $L_{12}$. In the depicted embodiment, the length $L_{12}$ is about 12.25 inches. It is to be understood that the length $L_{12}$ of the container 1000 can vary with other embodiments. The container 1000 has a height $H_6$. In the depicted embodiment, the height $H_6$ is about 1.4 inches. It is to be understood that the height $H_6$ can vary with other embodiments. The container 1000 has a width $W_4$. In the depicted embodiment, the width $W_4$ is about 5 inches. It is to be understood that the width $W_4$ can vary with other embodiments.

In one embodiment, the container 1000 includes rails 1012 on the two sides 1004 of the container 1000. The rails 1012 can be configured to slide the container 1000 into the beverage dispenser 100. The container 1000 with the rails 1012 has a width $W_5$. In the depicted embodiment, the width $W_5$ is about 5.4 inches. It is to be understood that the width $W_5$ of the container 1000 can vary with other embodiments. The rails 1012 of the container 1000 allows for the container 1000 to be properly positioned within the beverage dispenser 100. Such an arrangement can help ensure that the container 1000 does not move within the beverage dispenser 100 or slide out of the beverage dispenser 100. The rails 1012 can have a width $W_6$. In the depicted embodiment, the width $W_6$ is about 0.23 inches. It is to be understood that the width $W_6$ of the rails 1012 can vary with other embodiments.

In one embodiment, the container 1000 includes a handle 1014 located at the rear surface 1008 of the container 1000. In one example, the handle 1014 can be used to properly position the container 1000 into the dispenser. The handle 1014 can include a lip 1013 that extends below thereof. The handle 1014 can be defined as being formed from one unitary piece with the container 1000. In other embodiments, the handle 1014 can be coupled to the rear surface 1008 of the container 1000 by other means such as fasteners or a weld mount. In the depicted embodiment, the handle 1014 extends a distance $D_1$ from the rear surface 1008 of the container 1000. The distance $D_1$ is about 0.6 inches. It is understood that the distance $D_1$ may vary with other embodiments. The handle can have a width $W_7$. In the depicted embodiment, the width $W_7$ can be about 3.3 inches. It is understood that the width $W_7$ can vary with other embodiments.

In certain examples, the container 1000 defines a landing 1016 in the front surface 1006 for receiving the fitment. In one example, the landing 1016 can include an elongated slot 1018 for guiding the fitment into the landing 1016. The landing 1016 can include an oval shaped ring 1020 formed below the elongated slot 1018 where the fitment can rest therein. The oval shaped ring 1020 curves outwardly from the elongated slot 1018.

In one embodiment, the landing 1016 may include a spring element or tab on either side of the landing 1016 for securely holding the fitment in the landing 1016. In some embodiments, the spring element may apply a positive downward force on the fitment or otherwise lock the fitment in place so as to ensure proper seating and alignment of the fitment within the container 1000. Moreover, the fitment may include a lip or flange that engages with a front surface of the container 1000 about the landing 1016 so as to prevent the fitment from passing through the landing 1016.

The fitment connects with plumbing inside the beverage dispenser 100 via a probe (not shown) to establish fluid communication between the beverage ingredients stored in the carton and the nozzle 118. Generally, the probe may be inserted into the fitment and engage with and open a plug (not shown) of the fitment, thereby establishing a fluid pathway for the beverage ingredients through the probe and on to the nozzle 118. Many of the possible aspects and features of the landing 1016 are disclosed or are similar to the landing 832 shown in FIG. 10. Accordingly, the descriptions and features of these structures are not repeated here for the landing 1016.

In one embodiment, the front surface 1006 includes a side 1022 and an angled side 1024 adjacent the side 1022. The angled side 1024 extends at an angle $\alpha_3$ toward one of the two sides 1004. In the depicted example, the angle $\alpha_3$ is about 30 degrees. It is understood that the angle $\alpha_3$ can vary with other embodiments. The configuration of the front surface 1006 is designed to fit inside the beverage dispenser 100 or any other dispenser.

In the example shown, the container 1000 is sized to receive a carton, such as cartons 204, 804. In one example, the carton 804 is positioned on one of the major surfaces 852 and loaded onto the container 1000. The angled surface 856 of the carton 804 corresponds to the angled side 1024 of the container 1000 to allow the major surface 852 of the carton 804 to sit flush with the base 1002 within the cavity 1010.

Referring to FIGS. 20*a-g*, a multi-view of another example of a container 2000 is shown. The container 2000 can include a base 2002, two sides 2004, a front surface 2006, and a rear surface 2008. The two sides 2004, the front surface 2006, and the rear surface 2008 can extend from the base 2002 to define a cavity 2010. In some examples, the container 2000 can be arranged and configured as a tray.

The container 2000 can be arranged and configured to hold a bag, pouch, bladder, or other flexible ingredient container (not shown) which stores beverage ingredients. In one example, the flexible ingredient container may include a fitment (not shown). The features of the flexible ingredient container and fitment are similar to those already described above. For example, the container 2000 can be configured to hold a carton, such as one of cartons 204, 804.

In one embodiment, the container 2000 has a length $L_{13}$. In the depicted embodiment, the length $L_{13}$ is about 336 mm. It is to be understood that the length $L_{13}$ of the container 2000 can vary with other embodiments. The container 2000 has a height $H_7$. In the depicted embodiment, the height $H_7$ is about 25 mm. It is to be understood that the height $H_7$ can vary with other embodiments. The container 2000 has a width $W_8$. In the depicted embodiment, the width $W_8$ is about 129 mm. It is to be understood that the width $W_8$ can vary with other embodiments.

In one embodiment, the two sides 2004 of the container 2000 each include a horizontal member 2012*a* and 2012*b* respectively. The horizontal member 2012*a* includes a flange member 2014 that extends outwards from the horizontal member 2012*a*. The flange member 2014 has ribs 2016 and a catch 2018 for locking the container 2000 in a dispenser. The container 2000 can be slid inside of a dispenser until the flange member 2014 locks the container 2000 therein. The flange member has a width $W_9$. In the depicted embodiment, the width $W_9$ is about 14 mm. It is to be understood that the width $W_9$ of the flange member 2014 can vary with other embodiments.

In one embodiment, the container 2000 includes a handle 2020 located at the rear surface 2008 of the container 2000. In one example, the handle 2020 can be used to properly position the container 2000 into the dispenser. The handle 2020 can be defined as being formed from one unitary piece with the container 2000. In other embodiments, the handle 2020 can be coupled to the rear surface 2008 of the container 2000 by other means such as fasteners or a weld mount.

The rear surface 2008 defines an opening 2022. The opening 2022 can be configured to provide ease inserting beverage ingredients in the cavity 2010 of the container 2000. It is to be understood that the arrangement and configuration of the rear surface 2008 and opening 2022 may vary with other embodiments.

In certain examples, the container 2000 defines a landing 2024 in the front surface 2006 for receiving the fitment. In one example, the landing 2024 can include an oval shaped ring 2026 where the fitment can rest therein.

In one embodiment, the landing 2024 may include a spring element or tab on either side of the landing 2024 for securely holding the fitment in the landing 2024. Moreover, the fitment may include a lip or flange that engages with a front surface of the container 2000 about the landing 2024 so as to prevent the fitment from passing through the landing 2024. Many of the possible aspects and features of the landing 2024 are disclosed or are similar to the landing 1016 shown in FIGS. 19*a-c*. Accordingly, the descriptions and features of these structures are not repeated here for the landing 2024.

In certain embodiments, the front surface 2006 can include a receptacle 2028 that extends therefrom and adjacent to the landing 2024. The receptacle 2028 can be used to capture drips or fluid from the fitment on the beverage ingredients pouch. The receptacle 2028 can be defined as being formed from one unitary piece with the container 2000. In other embodiments, the receptacle 2028 can be coupled to the front surface 2006 of the container 2000 by other means such as fasteners or a weld mount.

In one embodiment, the front surface 2006 includes a side 2030 and an angled side 2032 adjacent the side 2030. The angled side 2032 extends at an angle toward one of the two sides 2004. The configuration of the front surface 2006 is designed to fit inside the beverage dispenser 100 or any other dispenser. In the depicted example, the angle is about 30 degrees. It is understood that the angle can vary with other embodiments.

In the example shown, the container 2000 is sized to receive a carton, such as cartons 204, 804. In one example, the carton 804 is positioned on one of the major surfaces 852 and loaded onto the container 2000. The angled surface 856 of the carton 804 corresponds to the angled side 2032 of the container 2000 to allow the major surface 852 of the carton 804 to sit flush with the base 2002 within the cavity 2010.

Referring to FIGS. 21*a-f*, a multi-view of another example of a carton 3000 is shown. In some embodiments, the carton 3000 may be made, at least in part, of paperboard, cardboard, honeycomb board, or other inexpensive and relatively available materials. Other materials or laminates may be used to construct the carton 3000.

In one embodiment, the carton 3000 can include a top surface 3002, a bottom surface 3004, and two major surfaces 3006. The carton 3000 has a length $L_{14}$. In the depicted example, the length $L_{14}$ is about 9.9 inches. It is to be understood that the length $L_{14}$ can vary with other embodiments. The carton 3000 has a height $H_8$. In the depicted example, the height $H_8$ is about 4 inches. It is to be understood that the height $H_8$ can vary with other embodiments. The carton 3000 has a width $W_9$. In the depicted example, the width $W_9$ is about 1.3 inches. It is to be understood that the width $W_9$ can vary with other embodiments.

Other dimensions for the carton 3000 are possible. For example, in another embodiment, the length $L_{14}$ is approximately 11.5 inches, the height $H_8$ is approximately 4.6 inches, and the width $W_9$ is approximately 1.6 inches. In yet another embodiment, the carton 3000 dimensions are approximately 16.4 inches by 4 inches by 1.3 inches.

It should be understood that while the carton and containers (discussed above) are generally shown with a vertical orientation, they may also be modified to have a horizontal orientation without departing from the spirit or scope of the various embodiments described herein.

In certain embodiments, the bottom surface 3004 can include tape 3008 used to seal a pouch within the carton 3000 therein. In one aspect, the tape 3008 is an alternative to having a tear away portion on the carton 3000. The tape 3008 allows the user to easily grasp and tear away a portion of the carton 3000 to access the pouch.

The carton 3000 includes a protective layer 3010 on the top surface 3002. The protective layer 3010 can be adhered to the top surface 3002 by, for example, adhesive. The protective layer 3010 has a length $L_{15}$. In the depicted example, the length $L_{15}$ can be about 9.0 inches. It is to be understood that the length $L_{15}$ can vary with other embodiments. The protective layer 3010 has a width $W_{10}$. In the depicted example, the width $W_{10}$ can be about 1.0 inch. It is to be understood that the width $W_{10}$ can vary with other embodiments. When the protective layer 3010 is adhered to the carton 3000, the carton 3000 can have a height $H_9$.

The protective layer 3010 has a distal end 3012 and a proximal end 3014. In certain examples, the proximal end 3014 can have a flat portion 3016 and sides 3018 that taper adjacent to the flat portion 3016. The sides 3018 can taper at an angle $\alpha_4$ from the flat portion 3016. In the depicted example, the angle $\alpha_4$ is about 45 degrees. It is to be understood that the angle $\alpha_4$ can vary with other embodiments.

In certain embodiments, the carton 3000 includes a radio frequency identification (RFID) chip 3020. The RFID chip 3020 may be attached to an interior or exterior surface of the carton 3000. For example, as shown in FIGS. 21*a-f*, the RFID chip 3020 may be attached to the protective layer 3010. The RFID chip 3020 can be attached anywhere along the protective layer 3010. In some embodiments, the RFID chip 3020 may be attached to an interior surface of the carton 3000.

In other embodiments, the RFID chip 3020 may be embedded within a surface of the carton 3000. For example, the exterior surface may include a recess that may allow the RFID chip 3020 to be flush with the exterior surface. Moreover, the RFID chip 3020 may be embedded within the exterior surface and covered. The covering may be made of the same material the carton 3000 or made of a different material. The covering protects the RFID chip 3020. Many of the possible aspects and features of the RFID chip 3020 are disclosed or are similar to the RFID chip 406 shown in FIGS. 4*a-f*. Accordingly, the descriptions and features of this structure are not repeated here for the RFID chip 3020.

The carton 3000 also includes an angled side 3040. The angled side 3040 keys the carton 3000 so that the carton 3000 must be oriented in a certain direction while being inserted into a container.

Figure 22B:
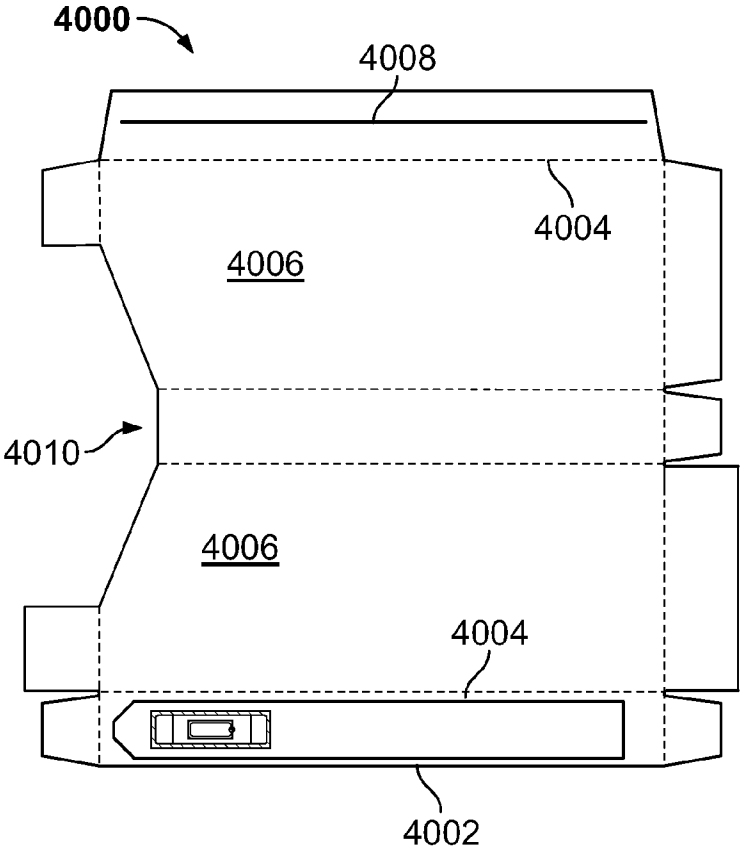
FIG. 22*b* shows an opposite side of the outline of FIG. 22*a*.
Figure 22A:
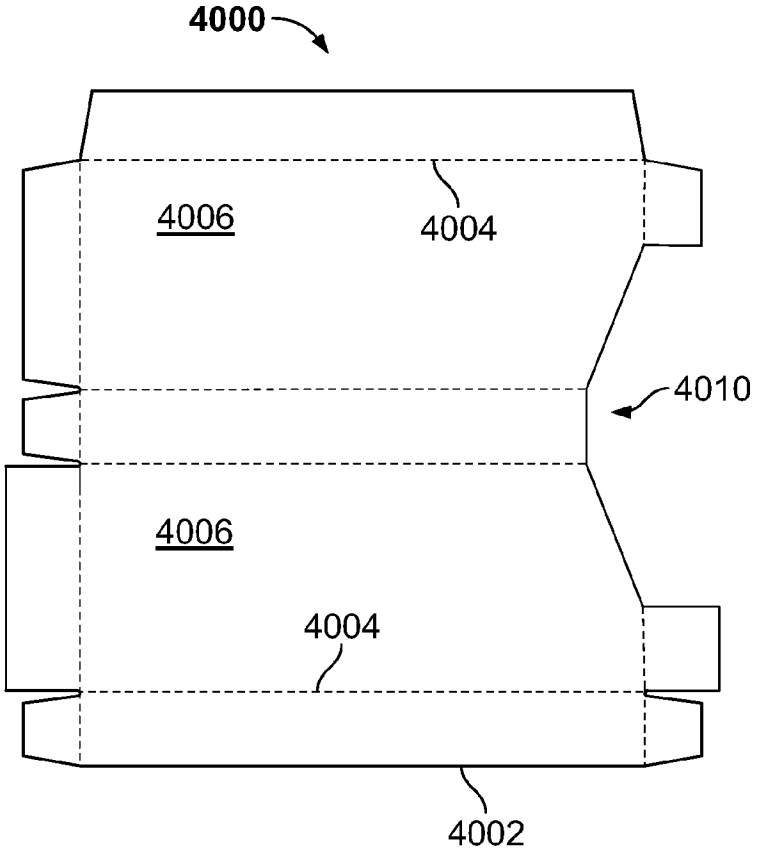
FIG. 22*a* shows one side of an outline of the carton of FIG. 21*a*.

Referring to FIGS. 22*a-b*, an outline 4002 for manufacturing the carton 3000 is shown. The outline 4002 of the carton 3000 can be stamped from a flat stock. In other embodiments, the outline 4002 of carton 3000 can be cut from a flat stock. The outline 4002 of the carton 3000 can include fold lines 4004 that are scored on a surface 4006 of the flat stock once the outline 4002 has been cut. In some examples, an adhesive striping 4008 is applied. The adhesive striping 4008 can be used after folding the flat stock along the fold lines 4004 to form an enclosure. The carton 3000 includes an open area portion 4010. The open area portion 4010 of the carton 3000 can be constructed by cutting away portions of the carton 3000. In some embodiments, the open area portion 4010 may be an alternative to having a tear away portion on the carton 3000. In certain embodiments, a tamper evidence perforation (not shown) may be provided on the carton 3000.

The method 500 for manufacturing the carton 204 and the container 202 described above is applicable to the containers 802, 902 and the cartons 804, 904 described above. Accordingly, the methods for manufacturing these structures and inserting the cartons containing a beverage ingredient into the beverage dispenser 100 are not repeated here.

The various examples described herein can be formed of different sizes. It is to be understood that the pouch type, pouch size, pouch volume and carton size may vary with other embodiments. For example, the size of a particular carton can be dictated by several factors. One factor is the amount of beverage ingredient to be stored in the carton. The amount can be varied to optimize the longevity of the ingredient. Another factor is the size and shape of the beverage dispenser into which the carton is to be placed. Yet another factor is the mechanisms used to ship the cartons.

Below is a table depicting the unique combinations of pouch type, pouch size, pouch volume, and carton size. It will be appreciated that these values may vary with other embodiments depending on one or more of the factors described above.

| Carton Height (inches) | Carton Length (inches) | Carton Width (inches) |
|---|---|---|
| 4.047 | 9.962 | 1.309 |
| 4.047 | 5.252 | 1.309 |
| 4.688 | 11.500 | 1.625 |
| 4.047 | 5.252 | 1.309 |
| 4.147 | 9.962 | 1.309 |
| 4.147 | 9.962 | 1.391 |
| 4.047 | 9.962 | 1.391 |

These dimensions allow for bags within the cartons to vary in size. The bags can hold, for example, beverage ingredients of approximately 0.5-1.0 liters depending on the size of the carton. In some examples, the bags hold 0.147 liters, 0.651 liters, 0.7 liters, or 1.0 liters.

Both the foregoing general description and the following detailed description are examples and explanatory only, and should not be considered to restrict the disclosure's scope, as described and claimed. Further, features and/or variations may be provided in addition to those set forth herein. For example, embodiments may be directed to various feature combinations and sub-combinations described herein.

While certain embodiments have been described, other embodiments may exist. While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as examples for embodiments of the disclosure.

What is claimed is:

1. A container for insertion of a carton containing a beverage ingredient into a beverage dispenser, the container comprising:

a base surface; and a front surface, a back surface, and two side surfaces extending from the base surface and defining a cavity sized to receive the carton;

wherein the two side surfaces extend from the front surface at an angle and form a horizontal landing portion that extends to the back surface; and wherein the base surface defines an alignment groove extending at least partially from the front surface to the back surface.

2. The container of claim 1, wherein the landing portion is a flat planar surface.

3. The container of claim 2, wherein the landing portion is positioned to engage an interior structure of the beverage dispenser arranged and configured to provide downward force upon the container.

4. The container of claim 3, wherein the interior structure secures the container to minimize movement of the container relative to the beverage dispenser.

5. The container of claim 1, wherein the front surface defines a landing sized to receive a fitment attached to the carton.

6. The container of claim 5, wherein the landing includes an oval shaped ring formed below an elongated slot, wherein the fitment slides through the elongated slot and rests on the oval shaped ring when the carton is inserted into the container.

7. A system for installing a beverage ingredient into a beverage dispenser, the system comprising:

a container for insertion of a carton containing a beverage ingredient into a beverage dispenser, the container including a base surface, and a front surface, a back surface, and two side surfaces extending from the base surface and defining a cavity sized to receive the carton; wherein the two side surfaces extend from the front surface at an angle and form a horizontal landing portion that extends to the back surface; and a carton positioned within the container and containing the beverage ingredient, the carton comprising a fitment extending from a carton surface, the fitment sized to allow fluid communication between the carton and the beverage dispenser, and the carton defining a tear away portion defining an angled surface extending from a front surface of the carton to a side surface of the carton.

8. The system of claim 7, wherein the landing portion is a flat planar surface.

9. The system of claim 8, wherein the landing portion is positioned to engage an interior structure of the beverage dispenser arranged and configured to provide downward force upon the container.

10. The system of claim 7, wherein the tear away portion covers and protects the fitment.

11. The system of claim 10, wherein the tear away portion is removed to expose the fitment.

12. The container of claim 5, wherein the fitment is sized to allow fluid communication between the carton and the beverage dispenser.

13. The container of claim 12, wherein the carton defines a tear away portion defining an angled surface extending from a front surface of the carton to a side surface of the carton.

14. The container of claim 13, wherein the tear away portion covers and protects the figment.

15. The container of claim 13, wherein the tear away portion is removed to expose the figment.

16. The container of claim 13, wherein the tear away portion includes a perforated line that allows the tear away portion to be removed from the carton.

17. A container for insertion of a carton containing a beverage ingredient into a beverage dispenser, the container comprising:

a base surface; and a front surface, a back surface, and two side surfaces extending from the base surface and defining a cavity sized to receive the carton;

wherein the two side surfaces extend from the front surface at an angle and form a horizontal landing portion that extends to the back surface;

wherein the front surface defines a landing sized to receive a fitment attached to the carton; and wherein the landing includes an oval shaped ring formed below an elongated slot, wherein the fitment slides through the elongated slot and rests on the oval shaped ring when the carton is inserted into the container.

18. A container for insertion of a carton containing a beverage ingredient into a beverage dispenser, the container comprising:

a base surface; and a front surface, a back surface, and two side surfaces extending from the base surface and defining a cavity sized to receive the carton;

wherein the two side surfaces extend from the front surface at an angle and form a horizontal landing portion that extends to the back surface; and wherein the back surface defines an opening sized to allow a product label located on the carton to be visible when the carton is located within the container.

19. A container for insertion of a carton containing a beverage ingredient into a beverage dispenser, the container comprising:

a base surface; and a front surface, a back surface, and two side surfaces extending from the base surface and defining a cavity sized to receive the carton;

wherein the two side surfaces extend from the front surface at an angle and form a horizontal landing portion that extends to the back surface;

wherein the front surface defines a landing sized to receive a fitment attached to the carton; and wherein the fitment is sized to allow fluid communication between the carton and the beverage dispenser.

20. The container of claim 19, wherein the carton defines a tear away portion defining an angled surface extending from a front surface of the carton to a side surface of the carton.

21. The container of claim 20, wherein the tear away portion covers and protects the figment.

22. The container of claim 20, wherein the tear away portion is removed to expose the figment.

23. The container of claim 20, wherein the tear away portion includes a perforated line that allows the tear away portion to be removed from the carton.

24. A container for insertion of a carton containing a beverage ingredient into a beverage dispenser, the container comprising:

a base surface; and a front surface, a back surface, and two side surfaces extending from the base surface and defining a cavity sized to receive the carton;

wherein the two side surfaces extend from the front surface at an angle and form a horizontal landing portion that extends to the back surface;

wherein the carton includes an angled side so that the carton is oriented properly when received into the container.

25. A container for insertion of a carton containing a beverage ingredient into a beverage dispenser, the container comprising:

a base surface; and a front surface, a back surface, and two side surfaces extending from the base surface and defining a cavity sized to receive the carton;

wherein the two side surfaces extend from the front surface at an angle and form a horizontal landing portion that extends to the back surface; and wherein a RFID chip is coupled to the carton.

* * * * *